US005524992A

United States Patent [19]

Takeuchi et al.

[11] Patent Number: 5,524,992

[45] Date of Patent: Jun. 11, 1996

[54] SMALL PRINTER

[75] Inventors: Shin Takeuchi; Seiya Sato, both of Nagano, Japan

[73] Assignee: Seiko Epson Corporation, Tokyo, Japan

[21] Appl. No.: 305,352

[22] Filed: Sep. 13, 1994

[30] Foreign Application Priority Data

| | | | |
|---|---|---|---|
| Sep. 13, 1993 | [JP] | Japan | 5-227470 |
| Jun. 1, 1994 | [JP] | Japan | 6-120392 |
| Sep. 8, 1994 | [JP] | Japan | 6-214795 |

[51] Int. Cl.[6] ..... B41J 1/20

[52] U.S. Cl. ..... 400/146; 101/93.14

[58] Field of Search ..... 101/93.13, 93.14, 101/93.04; 400/118.1, 124.24, 124.27, 146, 124.29

[56] References Cited

U.S. PATENT DOCUMENTS

| | | | |
|---|---|---|---|
| 4,428,285 | 1/1984 | Cole et al. | 400/146 X |
| 4,444,103 | 4/1984 | Cronin | 101/93.13 |
| 4,596,479 | 6/1986 | Lean et al. | 400/146 X |

FOREIGN PATENT DOCUMENTS

| | | | |
|---|---|---|---|
| 0029548 | 2/1986 | Japan | 400/146 |

*Primary Examiner*—Christopher A. Bennett
*Attorney, Agent, or Firm*—Sughrue, Mion, Zinn, Macpeak & Seas

[57] ABSTRACT

A small printer is disclosed which contains a character member, such as a character ring or a character belt. The character member comprises a plurality of character bodies which are connected by coupling portions and which comprise dot-like projections which form dot characters. The small printer also has a device to rotate the character member in order to place a desired dot character body which contains the dot character to be printed between a hammer and a piece of paper. Subsequently, the hammer strikes the desired character body and the dot character is printed on the paper. Since the small printer has the above-described construction, the small printer is less expensive and smaller than conventional printers.

21 Claims, 15 Drawing Sheets

( n1=1, n2=3 )

30c-4

30c-3

30c-2

30c-1

30c-8

30c-7

30c-6

30c-5
(n1=3, n2=1)

31c-6

31c-5

31c-4

31c-3

31c-2

31c-1

31c-12

31c-11

31c-10

31c-9

31c-8

31c-7

31c-16

31c-15

31c-14

31c-13
( n1 = n2 = 2 )

SMALL PRINTER

BACKGROUND OF THE INVENTION

1. Field of the Invention

The present invention relates to a small printer which uses a character member, such as a character ring or a character belt. The character member comprises linked dot character bodies that each have a dot character on the top face thereof. The present invention prints characters on a print paper by striking the character bodies with a hammer. More particularly, the invention relates to the arrangement of the dot characters on the character member and a print mechanism that uses the dot character arrangements.

2. Discussion of the Related Art

Several small printers that use a character rings or character belts which comprise a number of linked characters are known. Published Unexamined Japanese Patent Application No. Sho. 62-119054 discloses a small printer which utilizes a character drum that is elongated in the horizontal direction. A character sheet having a plurality of dot characters are wound around the drum.

Published Unexamined Japanese Patent Application No. Sho. 57-128567 also discloses a small printer that comprises a character drum which is elongated in the horizontal position. Character rings that each have a plurality of dot characters are wound around the drum, and the number of the character rings is equal to the number of character positions of one line of text to be printed.

In addition, Published Unexamined Japanese Patent Application No. Sho. 56-38275 discloses a small printer which is similar to the printer disclosed in Published Unexamined Japanese Patent Application No. Sho. 57-128567.

The conventional small printers which use conventional character drums, character sheets, or character rings have several problems. For instance, the size of the conventional character ring cannot be reduced. Accordingly, there is a limit in further reducing the size of the printer and further reducing the cost of manufacturing the printer. In addition, the conventional small printers do not have the ability to print graphics.

In the printer of Published Unexamined Japanese Patent Application No. Sho. 62-119054, a protrusion on the character sheet which forms one dot is located at a character position. A standard text character is 5 dots (or 5 character positions) wide and 7 dots (or 7 character positions) tall. Therefore, a standard text character may be represented by a matrix of 7 dots×5 dots (i.e., a matrix consisting of 7 dots in the vertical or column direction and 5 dots in the horizontal or row direction). Consequently, in the printer disclosed in the publication, a total of 35 (7×5) character positions must be used. Thus, the size of the character sheet limits the ability to reduce the size of the printer.

In addition, the print operation is repeated a plurality of times at the same horizontal location of the line of text. Therefore, when a printer is used as a character-type serial printer, a print/character advance operation must be repeated each time the character sheet is horizontally advanced. Consequently, serial printers using the printing technique disclosed in the publication are expensive.

Also, when using the above printing technique, the printing hammer, which creates a printed dot on the paper by striking a character position on the character sheet, strikes the character sheet at a point which is significantly displaced from the dot-like protrusion. Consequently, the printed characters become chipped and are smudged due to the hammer inadvertently striking a portion of an adjacent character position. Additionally, it is impossible to print characters of different sizes and fonts since only one type of dot is used.

Furthermore, in the conventional printers, the character member takes the form of a long drum with a large diameter. Thus, the size of the drum limits the ability to reduce the size of the printer.

In addition, the printers disclosed in Published Unexamined Japanese Patent Application Nos. Sho. 57-128567 and 56-38275 require a character member for each character to be printed in a line of text. This requirement increases the number of required parts, limits the ability to reduce the size of the printers, and increases the cost of the printers. Also, since there are many character rings, it is impossible to provide adequate spacing between the adjacent character rings. Therefore, an area located outside the vicinity of the character rings is required in which to connect the hammer lever to the hammer drive solenoid. In addition, in order to prevent the printed characters from becoming smudged, a fixed space is required to prevent the adjacent character rings from interfering with one another. Finally, the printers disclosed in the publications are not suitable for printing graphics, patterns, and characters of desired sizes and fonts. This problem becomes even more serious when the dot pitches are reduced to improve the resolution of the printed characters.

An object of the present invention is to provide a printer with a character member containing dot characters, which is inexpensive and is capable of printing graphics.

Another object of the present invention is to provide a small printer, which includes a character member that does not print chipped or smudged characters, includes a drive mechanism for driving the character member, and is capable of printing high quality characters at a high resolution.

Yet another object of the present invention is to provide a small printer with a character member which enables the printer to print characters of different sizes and fonts.

Still another object of the present invention is to provide a small dot matrix printer which prints one line at equal pitches with a single character belt.

SUMMARY OF THE INVENTION

To solve the above mentioned problems, the present invention provides a small printer comprising a character member that comprises a plurality of linked character bodies arrayed on the surface thereof, a select mechanism for selecting a desired character body, a hammer for pressing the selected character body against a print paper, a pushing mechanism for driving the hammer, and a character advance mechanism for moving the hammer in a horizontal direction of a line of text on the print paper.

The character member of the small printer has a plurality of character bodies. Some of the character bodies are dot character bodies, and the surface of each dot character body can be represented by a dot pattern matrix having n1 rows and n2 columns which form N matrix locations. Combination patterns are created by forming dot-like projections in select matrix locations on the surface of the dot character body and not forming dot-like projections in other select matrix locations. Each particular combination pattern on each dot character body represents a dot character. The character member has a dot character body for each possible combination pattern of dot-like projections which can be formed in the matrix locations (i.e. for each dot character).

For example, when the surface of a dot character body is represented by a 1×2 matrix, four dot character bodies are needed to represent each possible combination pattern. The first dot character body has no dot-like projections in any matrix location. The second dot character body has a dot-like projection in the matrix location (1, 1). The third dot character body has a dot-like projection in the matrix location (1, 2). Finally, the fourth dot character body has a dot-like projection in both matrix locations (1, 1) and (1, 2).

When n2=1 the distance p16 that the hammer moves when it is moved in the horizontal direction by the character advance mechanism is equal to the distance p2 between the dot forming positions of adjacent columns of the dot pattern matrix (i.e., the dot pitch in the horizontal or character advance direction). When n2≧2, the distance p16 that the hammer moves is equal to the product of the distance p2 between the dot forming positions between adjacent columns of the dot pattern matrix and n2.

In order to print all of the dot characters, the character member must contain at least one dot character body for each of the possible combination patterns of dot-like projections. However, if the character member contains a plurality of the dot character bodies which have dot characters that are frequently printed, it is possible to quicken the positioning operation of a dot character body for printing.

In addition to dot character bodies, the character member may comprise dot-like character bodies. Dot-like character bodies are character bodies that have characters which resemble dot characters. (These characters will be referred to as dot-like characters in this specification). However, dot-like character bodies have dot-like characters which are comprised of contiguous dots. Therefore, if a dot character body would have dots spaced extremely close to each other, it is preferable to use dot-like characters which are made of "dots" that have no spaces between them. The use of such characters eliminates the deterioration of print quality which is caused by ink filling in the gaps between the dots of ordinary dot characters.

Furthermore, the size or shape of the dot or dots forming the dot character on the dot character bodies may vary. In other words, the printed characters may have different sizes and fonts.

In addition to the character member, the small printer of the present invention further comprises a paper feed mechanism for feeding the print paper at incremental distances in the direction perpendicular to the moving direction of the hammer. In the printer, the paper feed mechanism feeds print paper incrementally by a distance p17. The distance p17 is calculated as follows. When n1=1, the paper feed distance p17 is equal to the distance p1 between the dot forming positions of adjacent rows of the dot pattern matrix. When n1≧2, the paper feed distance p17 is equal to the product of the distance p1 between the dot forming positions of adjacent rows of the dot pattern matrix and n1.

The character member of the present invention may also comprise a looped character belt provided in the horizontal direction. The character belt includes a plurality of character bodies arrayed on the surface thereof which are linked by coupling portions. In addition, the small printer comprises support means for supporting the character belt such that the character belt is rotatable in the horizontal direction, a select mechanism which includes a drive mechanism for rotating the character belt and for stopping the character body when a desired character body is between the hammer and the print paper, a hammer for pressing the selected character body against the print paper, and a character advance mechanism for moving the hammer in the horizontal direction after a character is printed.

The character belt includes dot character bodies which have dot forming positions allocated on their surfaces. Corresponding dot forming positions on adjacent dot character bodies are separated by a pitch p11. Each dot character body includes n columns of dot forming positions (n≧2) that are equidistantly disposed at pitches p12. Also, a distance p13 represents the minimum character advance distance that the hammer is moved in the horizontal direction of the character belt during a character advance operation. The pitch p11 of the dot character bodies, the pitch p12 of the dot forming positions, and the distance p13 are selected so as to satisfy the following two equations.

$$p11=p12\times n\times m1 \quad (1)$$

$$p11=p13\times m1 \quad (2)$$

where m1 is a positive integer.

With this construction, the dot distances can be kept uniform in the horizontal direction.

To secure a sufficient dot distance between adjacent dot character bodies, the following equation must also be satisfied.

$$p14=p12\times m2 \quad (3)$$

The distance p14 represents the shortest distance between dot-like projections which are each located on adjacent dot character bodies, and m2 is an integer greater than 2.

The character belt may also comprise a space character body. A space character body is a character body that has no dots formed on its surface. The portion of the character belt on which the space character body is formed should be thinner than the portions on which other character bodies are formed. With this design, less tension is exerted on a space character body by the adjacent character bodies during the printing operation. Consequently, the printed character rarely becomes smudged by the adjacent character bodies. Furthermore, the load to the hammer during the printing operation is reduced.

The character belt may also comprise character bodies on which normal characters (nondot characters) are formed, such as characters and symbols. In this case, each nondot character body consists of a character seat with a character disposed thereon. The length of the character seat of the nondot character body, as viewed in the horizontal direction, should be shorter than that of the dot character body. If the character seat length is so selected, the character seat of the nondot character body is not significantly affected by the adjacent characters bodies during printing, and smudging is reduced.

The pitch p15 of the nondot character body may be calculated as follows:

$$p15=p13. \quad (4)$$

In the equations (1) and (2) , if $$m1>1, \quad (5)$$

the dot character bodies are arrayed at pitches two times as long as the distance of the belt feed.

In addition, the coupling portions between the dot character bodies may be positioned in front of the printing position of the hammer in order to print a space (no dots) on the print paper. This operation is called the space printing operation. During this operation, the printing operation is normally carried out, but nothing is printed on the print paper.

The support means for supporting the character belt may comprise a drive pulley and a follower pulley which support the character belt such that the character belt is rotatable in the horizontal direction. Furthermore, a belt toothed part of the character belt that meshes with the drive pulley is formed on the coupling portion to reliably couple the character belt with the drive pulley. In addition, the height of the belt toothed part of the coupling portion should be lower than the height of the belt toothed part of the character body. With this design, the displacement of the belt is reduced when it is pushed by the hammer. Thus, the adjacent characters do not smudge the printed character during the printing operation.

The small printer of the present invention has a character member on which an array dot character bodies are formed. The dot character bodies contain dot characters that correspond to dot patterns that may be formed by a plurality of dots. Accordingly, a decreased number of character positions are necessary for printing a desired character expressed by a dot matrix. Consequently, the size of the character member, and hence the size of the whole printer, can be reduced.

The printer also includes dot characters that are different in size and shape. With this feature, the printer can print characters of different sizes and fonts which cannot be printed by conventional printers.

Additionally, the paper feed distance and the distance of the horizontal movement of the carriage carrying a hammer are selected depending on the number of dots formed on the dot character bodies and the pitch of the dots. Therefore, the dots can be formed with uniform pitches in both the vertical and horizontal directions.

Also, the specifications of the small printer, which comprises a character belt on which an array dot character bodies are formed, satisfy the formulae (1) through (5). Therefore, the pitches of the dots arrayed in the vertical direction are uniform. Furthermore, the length of the coupling portions for coupling dot characters and the distance between the dot characters located closest to each other on the adjacent dot character bodies are satisfactorily secured. Therefore, less tension is exerted on a character body by adjacent character bodies during the printing operation.

DETAILED DESCRIPTION OF THE PREFERRED EMBODIMENTS

Figure 1:
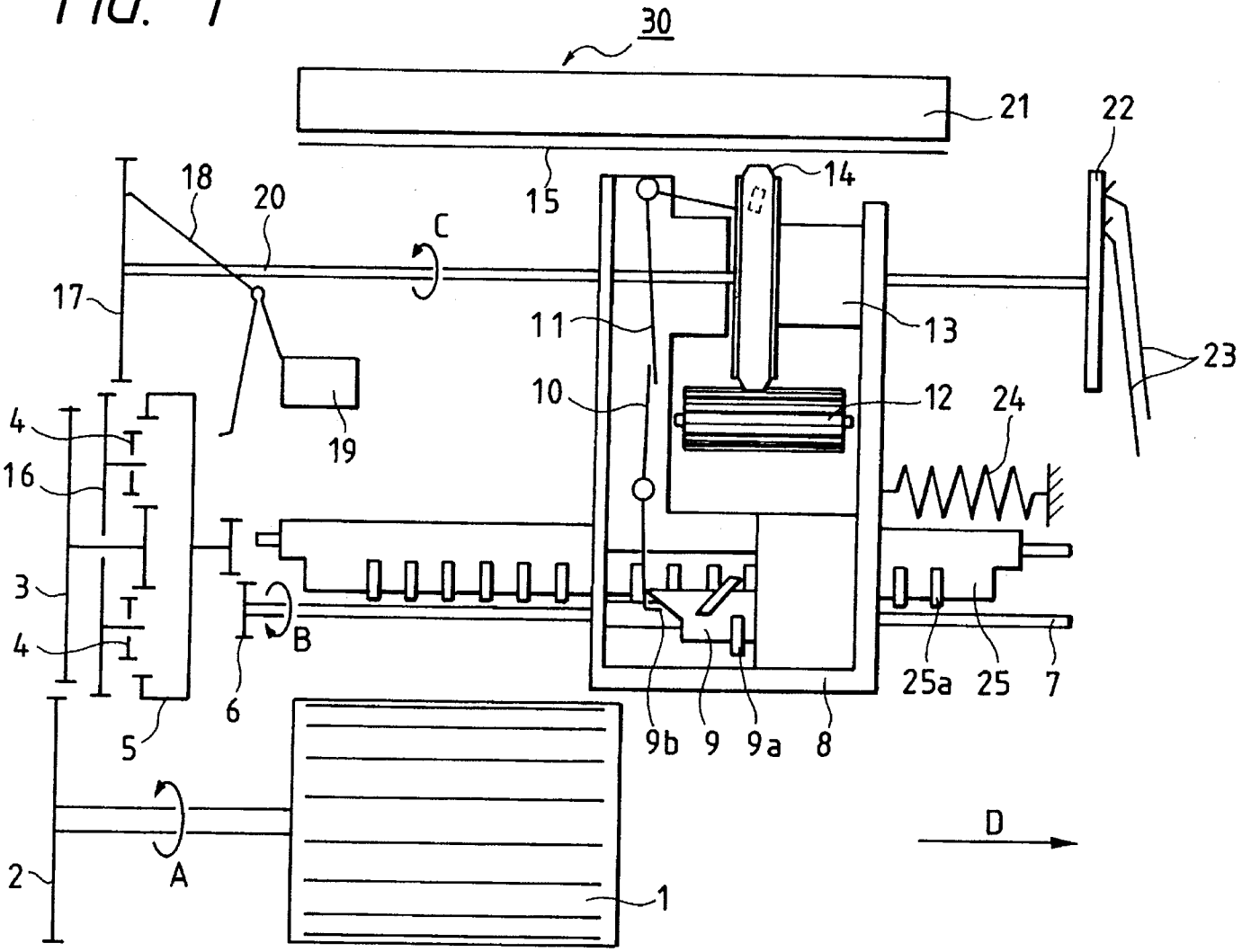
FIG. 1 is a schematic view of a small printer according to a first embodiment of the present invention.
Figure 2:
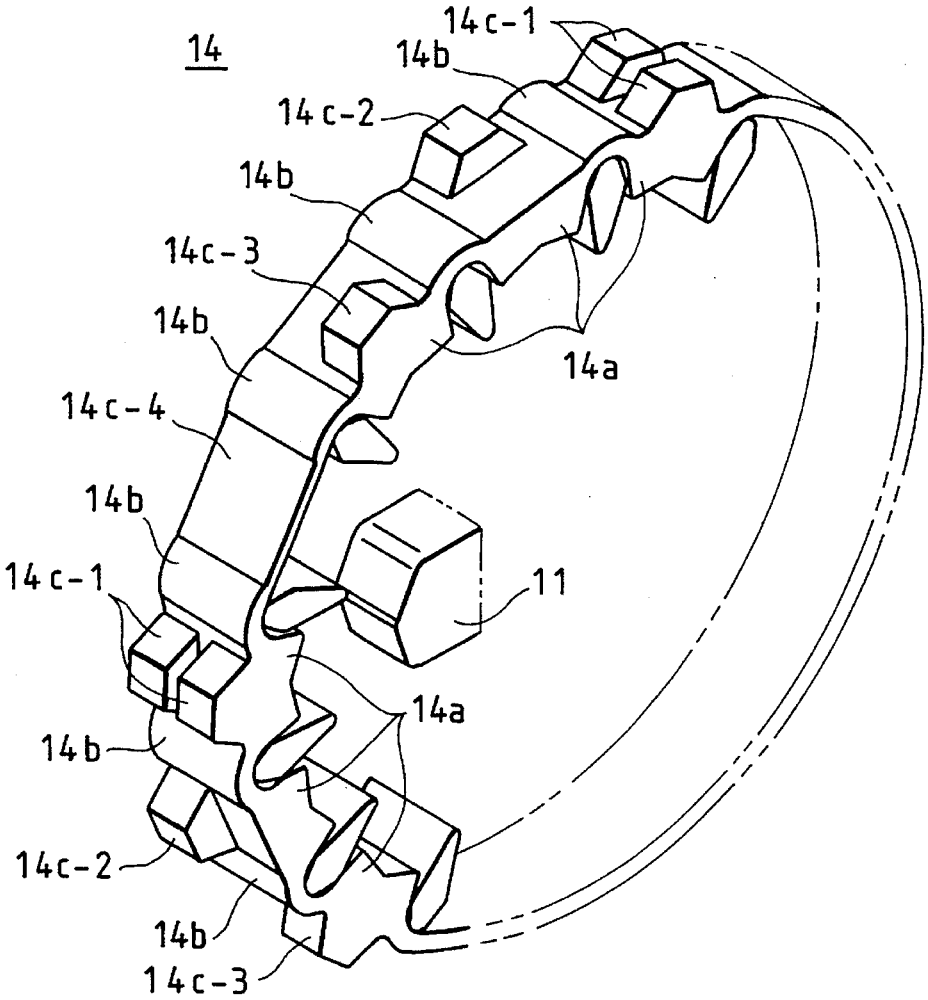
FIG. 2 is a perspective view of a print ring used in the small printer according to the first embodiment.

FIG. 1 is a schematic diagram of a serial printer 30 according to a first embodiment of the present invention. FIG. 2 is a perspective view of a character ring 14 of the first embodiment.

The basic construction of the serial printer 30 according to this embodiment is substantially the same as that disclosed in Published Unexamined Japanese Patent Application No. Sho. 58-145472. Therefore, only the construction of the serial printer which is necessary for explaining the present invention will be described.

As shown in FIG. 1, a motor 1 rotates a shaft in the direction of the arrow A. This rotation drives a print switch gear 5 and a first select drive gear 16 through a motor gear 2, a reduction gear 3, and planetary gears 4. The rotation, which reaches the print switch gear 5, is transmitted through a second select drive gear 6 to a print shaft 7. In turn, the print shaft 7 is turned in the direction of an arrow B. The rotation, which reaches the first select drive gear 16, is transmitted through a select gear 17 to a character ring shaft 20. Consequently, the character ring shaft 20 is turned in the direction of an arrow C.

In order to rotate the print shaft 7, a select pawl 18, driven by an electromagnet 19, must be selected to engage the print switch gear 5. On the other hand, to rotate the character ring shaft 20, the select pawl 18 must be selected to engage the select gear 17. When the select gear 17 is engaged, the print switch gear 5 is disengaged and vice versa.

A print cam 9 is fastened to the print shaft 7. The print cam 9 is axially slidable along the print shaft 7 and is turned in phase with the print shaft 7 and is also mounted to a carriage 8. When the print cam 9 rotates one turn, a cam **9*b* drives a hammer 11 via a hammer transmit lever 10. As a result, the hammer 11 strikes the character ring 14, and the character ring 14 is pressed against a platen 21. Consequently the character ring 14, which receives ink from an ink roll 12 and is attached to a character ring support 13, prints a desired character on a print paper 15. At this time, a character advance read 9*a* engages a protrusion 25*a* of a positioning plate 25, thereby advancing the carriage 8** horizontally by one position.

The character ring shaft 20 is coupled to the character ring support 13 and a detecting wheel 22. The character ring support 13 is axially slidable along the character ring shaft 20 and rotates in phase with the character ring shaft 20. Also, the character ring support 13 is pulled in the direction of an arrow D, along with the carriage 8, by a carriage spring 24.

During the printing operation, a portion of a character is printed, and the character advance read **9*a* incrementally advances the carriage 8 horizontally in a direction opposite to the arrow D (i.e., to the next character position). When the last portion of the last character of a line of text is printed, the positioning plate 25 is forcibly separated from the print cam 9. As a result, the carriage spring 24 pulls the carriage 8 to a home position located at the beginning of the next line of text (indicated by the arrow D). Timing pulses necessary for selecting a desired character body 14*a* and for carrying out the print operation are generated by a detecting brush 23, which slidably contacts the detecting wheel 22**.

As shown in FIG. 2, the character ring 14 is shaped like a ring and includes an array of character bodies **14*a* located at preset pitches on its outer surface. These character bodies 14*a* are linked to one another by thin coupling portions 14*b*. A dot character 14*c* is formed on the top face of each of the character bodies 14*a*. In this embodiment, up to one dot is printed in the vertical direction and up to two dots are printed in the horizontal direction during one printing operation. In other words, the top face of each character body 14*a* has an area which may be represented by a 1×2 dot pattern matrix. Therefore, one dot may be formed on the character body 14*a* in the vertical direction (paper feed direction) and two dots to be formed on the character body 14*a* in the horizontal direction (character advance direction). Accordingly, a surface of a character body 14*a* may have one of four dot patterns. Each dot takes the form of a quadrangular pyramid which has a trapezoidal cross section. In this embodiment, four types of dot characters 14*c*-1 to 14*c*-4, which correspond to the four dot patterns, are formed on the character bodies 14*a***.

In addition, several sets of character bodies **14*a*, each consisting of the four different dot characters 14*c*, are arranged along one character ring 14. As a result, the frequency of selecting a desired dot character 14*c* is increased, and hence, the printing speed is increased. If the character ring 14 is able to accommodate fourteen character bodies, four sets of dot characters (each set consisting of the four dot characters 14*c*-1 to 14*c*-4) may be arranged along twelve of the character bodies 14*a* of the character ring 14. In the remaining two segments of the character ring 14, the dot characters which are the most frequently be used (e.g., the dot characters 14*c*-2 and 14*c*-3) are located. Consequently, the durability of the character ring 14** is improved, and the printing speed of the printer is further improved.

In the character ring 14 illustrated in FIG. 2, the dot characters **14*c* are sequentially arranged. However, the dot characters 14*c* may be arranged differently according to the weight distribution of the character ring 14** or other mechanical restrictions.

Figure 3:
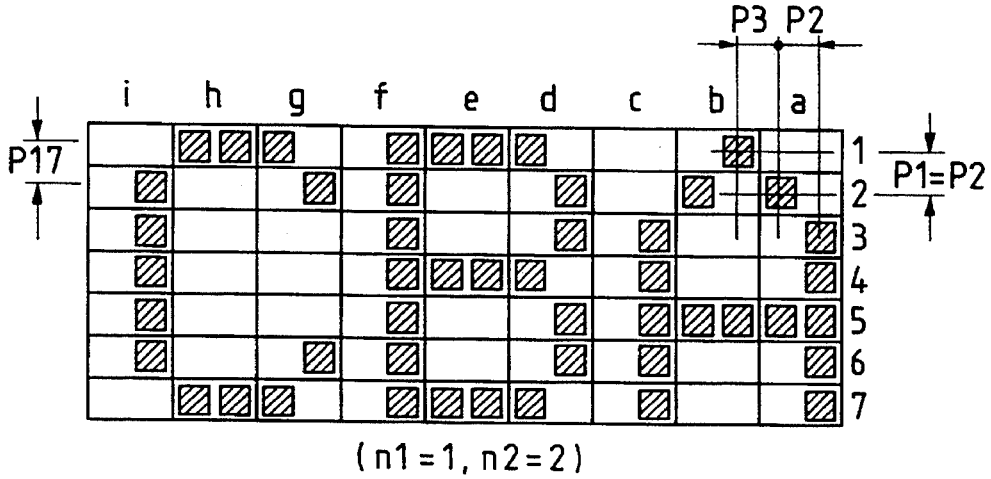
FIG. 3 is a diagram of the printing operation of the small printer according to the first embodiment.

The operation of printing text characters, which are usually expressed in a matrix of 7 dots in column and 5 dots in row, will be described with reference to FIG. 3. When the matrix of 7 dots×5 dots is divided by a 1 dot×2 dots dot pattern matrix, the resultant text matrix consists of 7 blocks in the vertical direction and 3 blocks in the horizontal direction. The printing operation starts when the carriage 8 is in the home position. The printer first prints the first block (block 1*a*) in the first dot line. Since the block 1*a* is blank, the dot character 14*c*-4 is selected and the print/character advance operation is carried out.

As a result of the character advance operation, the character ring 14 and the hammer 11 are moved from the location of the block 1*a* to the location of the next block to be printed, block 1*b*. In this case, the dot character 14*c*-2 is selected, and a dot pattern is printed as shown in block 1*b* of FIG. 3. The distance that the character ring 14 moves as a result of the character advance operation is two times as long as the distance p2. The distance p2 is the distance between dot forming positions of two dots of the same dot character 14*c*.

In the present embodiment, the maximum number n2 of dots of the dot character, as viewed in the horizontal direction (i.e. the character advance direction), is two. Hence the distance that the carriage 8 advances during a character advance is $$p2 \times 2.$$

Therefore, the distance p2 is equal to the dot distance p3 between the left-most dot forming position before the character advance operation and the right-most dot forming position after the character advance operation. Subsequently, the block 1*c*, the block 1*d*, and so on are printed in a similar way. After the print of the final block (block 1*h*) in the first dot line is completed, the carriage 8 is returned to the home position, and the print paper 15 is fed forward by the paper feed distance p17. The character ring 14 and the hammer 11 are moved to the location of the first block (block 2*a*) in the second dot line. The second dot line (block 2*a*, block 2*b*, block 2*c*, . . . , block 2*i*) is printed in the same manner as the first dot line. After the printing operation is continued up through the 7th dot line, the printing operation of one text line is completed.

The vertical distance p17 is the distance that the paper moves during the paper feed operation. The distance p17 is equal to the horizontal dot distance p2 or p3. In addition, the vertical dot distance p1 is equal to the horizontal dot distance p2. Thus, the horizontal and vertical dot distances are uniform (p1=p2=p3), and as a result, the characters are printed uniformly and evenly.

When a maximum number n1 of dots are arranged with a pitch p1 in the vertical direction (i.e. the paper feed direction), the paper feed operation advances the paper by an amount $$p1 \times n1.$$

Furthermore, to make the dot distances in the vertical and horizontal directions uniform, the following condition must also be satisfied.

$$p1 = p2.$$

While the standard text matrix of 7 dots×5 dots is used in the present embodiment, a different sized matrix can be used in the present invention. Furthermore, graphics can also be printed easily with the printer of the present invention.

Figure 4:
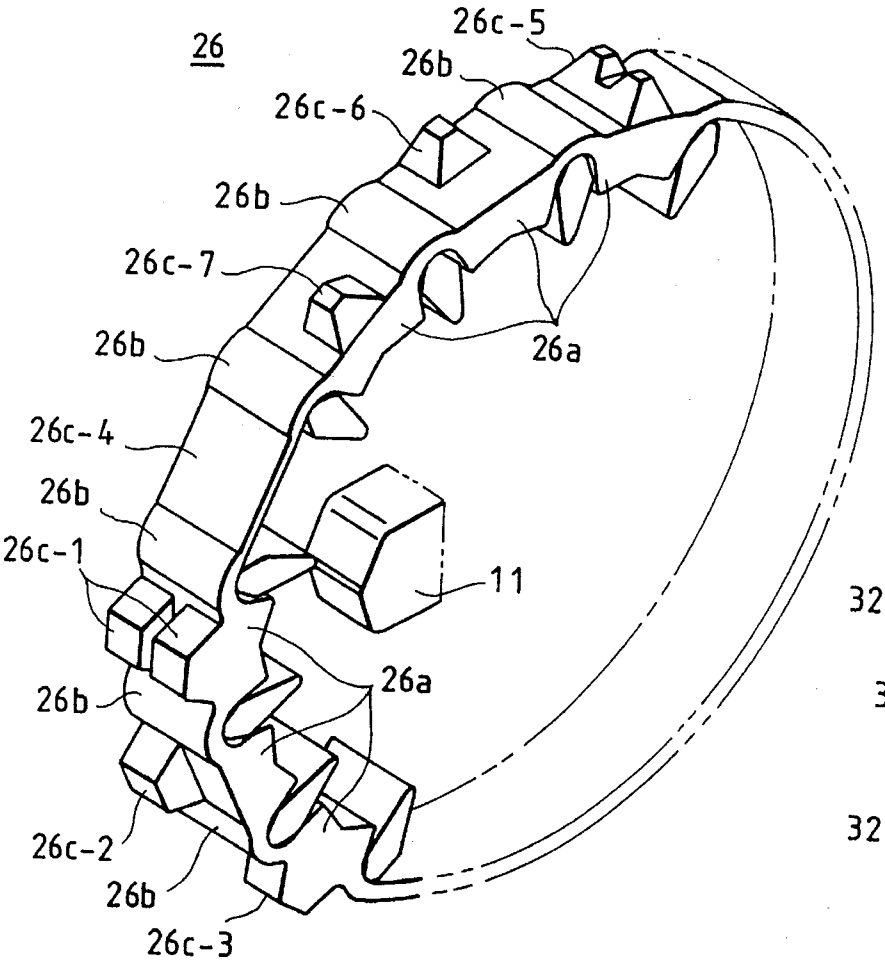
FIG. 4 is a diagram of a modified character ring of FIG. 2.

FIG. 4 shows a modified version of the character ring 14. In FIG. 2, the character ring 14 contains several sets of the same dot characters 14*c* on different character bodies 14*a*. In a character ring 26 shown in FIG. 4, small sized dot characters (26*c*-5, 26*c*-6, and 26*c*-7) and normal sized dot characters (26*c*-1, 26*c*-2, and 26*c*-3) are formed on the character bodies 26*a*. As a result of this construction, characters of different sizes can be printed. Alternatively, dot characters of different shapes, such as circular dots or square dots, may be used. Therefore, dot characters 26*c* having different sizes and fonts can be printed. Furthermore, when printing graphics, fine and delicate shading is possible.

It should be noted that such characters cannot be printed by conventional dot printers such as thermal printers, wire-dot printers, and ink-jet printers. Thus, the printer using the character ring 26 can produce a variety of prints and produce characters of higher quality than a conventional printer.

Figure 5:
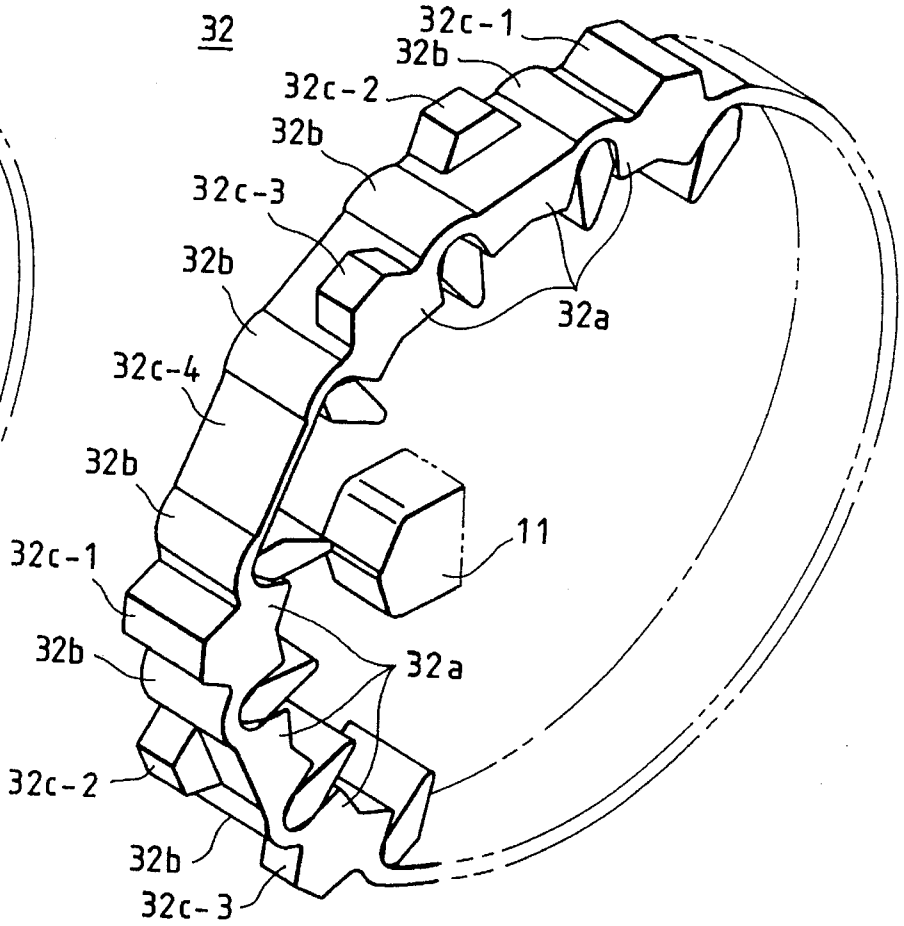
FIG. 5 is a diagram of another modified character ring of FIG. 2.

FIG. 5 is another modification of the character ring 14 of the first embodiment. In the character ring 32, two dots of the dot character 14*c*-1 of the character ring 14 have been substituted by a single rectangular dot-like character 32*c*-1. Since there is no space between the two dots of the dot-like character 32*c*-1, an sharper character is produced. Therefore, the printer using the character ring 32 does not encounter the problem of ink filling in the gaps between the dots, and consequently, the printed character is less blurred.

Figure 6:
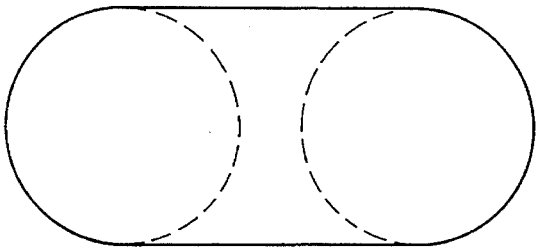
FIG. 6 is a diagram of a dot-like character resembling dot characters on the character ring of FIG. 5.
Figure 7:
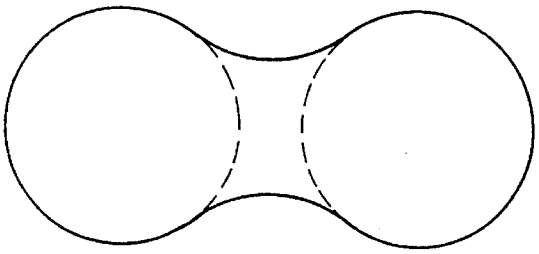
FIG. 7 is a diagram of another dot-like character resembling dot characters on the character ring of FIG. 5.

When the "dots" on the dot-like character bodies are circular, a dot-like character resembling the array of two circular dots, as shown in FIG. 6 or 7, may be used. In addition, any dot-like character may be used so long as it does not adversely affect the design of the printed character.

Figure 8:
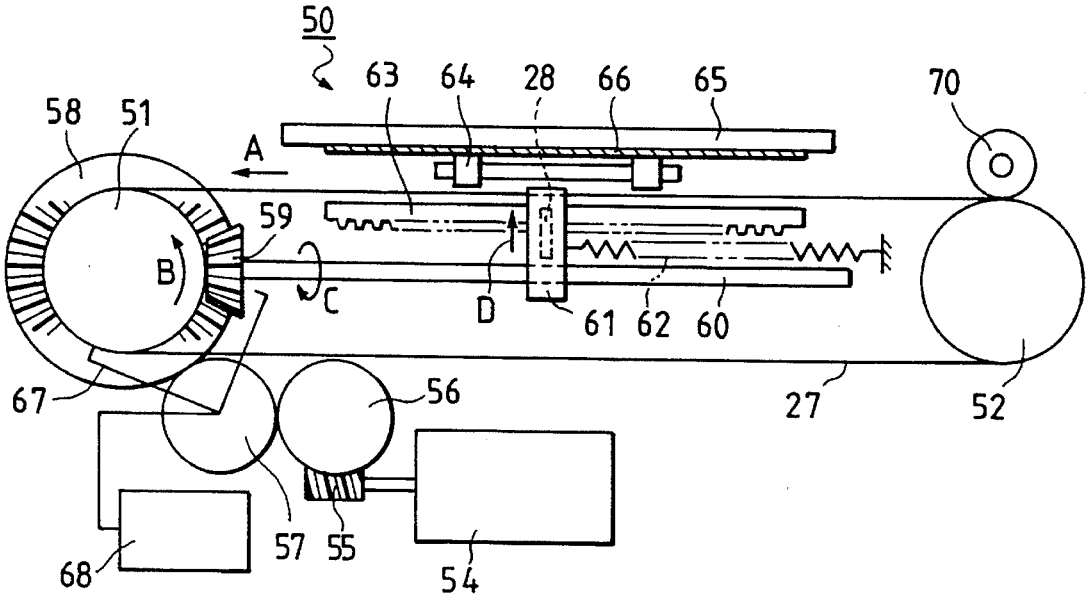
FIG. 8 is a schematic diagram of a printer with a character belt according to a second embodiment of the present invention.

FIG. 8 shows an overall construction of a printer 50 according to a second embodiment of the present invention. The basic construction of the printer 50 of this embodiment is substantially the same as the printer disclosed in Japanese Patent Publication No. 3-7512. Accordingly, in this specification, only the portions necessary for the explanation of the present invention will be described.

In the printer 50, a drive pulley 51 and a follower pulley 52 are separated a preset distance from each other, and a circular character belt 27 is wound around the drive pulley 51 and the follower pulley 52. A worm gear 55 is fastened to the rotary shaft of a DC motor 54. The drive force of the DC motor 54 is transmitted to a main gear 58, via the worm gear 55, a first idle gear 56, and a second idle gear 57. A rotation of the main gear 58 is transmitted through a spring clutch (not shown) to the drive pulley 51. A print/character advance gear 59 is meshed with the main gear 58. A number of threads is formed at equal pitches on the inner surface of the character belt 27. When the drive pulley 51 engages the threaded inner surface of the character belt 27, a rotation of the drive pulley 51 is transmitted to the character belt 27.

A print/character advance shaft 60 is located between the drive pulley 51 and the follower pulley 52, and one end of a print/character advance shaft 60 is coupled with the print/character advance gear 59. A hammer 28 and a character advance cam (not shown) are supported within the hammer holder 61, and the hammer holder 61 is slidably mounted on the print/character advance shaft 60. One end of a holder return spring 62 is coupled to the hammer holder 61, while the other end is fastened to the base. As a result, the hammer holder 61 is always pulled toward the home position (i.e. toward the follower pulley 52) by the holder return spring 62.

A rack 63 is disposed near to and in parallel with the print/character advance shaft 60. The character advance cam (not shown) contained in the hammer holder 61 is brought into engagement with the teeth of the rack 63. A paper feed roller 64 and a planar guide plate 65 are located on the rear side of the rack 63. A print paper 66 is fed from the underside of the paper feed roller 64 and the planar guide plate 65 and is guided to outside the character belt 27. A select lever 67, which is driven by an electromagnetic solenoid 68, disengages the main gear 58 from the drive pulley 51 and engages the main gear 58 with the print/character advance gear 59 at selected times. Thus, the transmission path of a rotation of the main gear 58 is selected. An ink roller 70 contacts the character portions on the outer surface of the character belt 27, thereby applying ink onto the character portions.

The basic operation of the printer 50 comprise, a series of sequentially repeated operations such as character select, print/character advance, and hammer holder return/paper feed. Through the sequential operations, a number of lines of characters are printed. In the character select mode, a rotation of the DC motor 54 is transmitted from the main gear 58 to the drive pulley 51, and the character belt 27 turns in the direction of an arrow A. When a desired character reaches a location in front of the hammer 28, current is fed to the electromagnetic solenoid 68. As a result, the select lever 67 selects the print/character advance gear 59 and the rotation of the main gear 58 is transmitted from the drive pulley 51 to the print/character advance gear 59.

As the result, the character belt 27 stops rotating, and the print/character advance shaft 60 rotates in the direction of an arrow C. The rotation of the print/character advance shaft 60 is transmitted to the hammer 28 through the character advance cam (not shown) so that the hammer 28 moves in the direction of an arrow D. The hammer 28 presses a character body 27*a* on the character belt 27 against the paper 66, and the dot character 27*c* is printed. After the hammer 28 is returned to a stand-by position, the character advance cam (not shown) engages the rack 63 and horizontally advances the hammer holder 61 by a character position (i.e. moves the hammer holder 61 to the left by one character position). After the character advance operation is complete, the select lever 67 automatically returns to its original position. Consequently, the main gear 58 disengages from the print/character advance gear 59 and engages the drive pulley 51. The rotation of the main gear 58 is then transmitted to the drive pulley 51.

The distance by which the hammer holder 61 is moved during a character advance operation is equal to the pitch of the character bodies 27*a* on the character belt 27. When the sequence of character select, print/character advance, and hammer holder return/paper feed is repeated by the number of character positions, one line of text is printed. After the print of one line is printed, the rack 63 is disengages from the character advance cam (not shown), and the hammer holder 61 returns to the home position. At the same time, the paper feed operation is executed and the paper is fed by one line.

Figure 9:
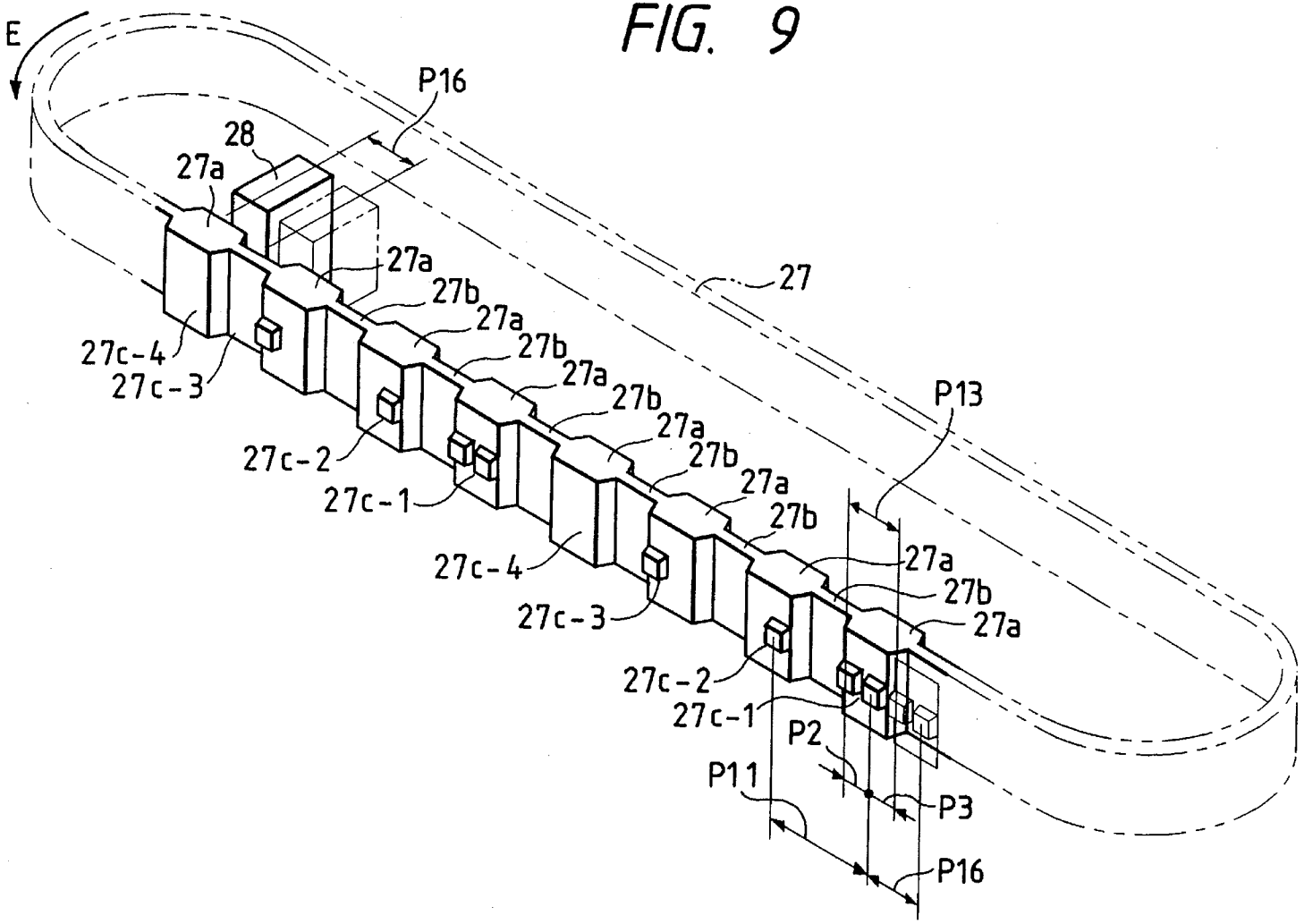
FIG. 9 is a perspective view of a character belt used in the printer shown in FIG. 8.
Figure 10A:
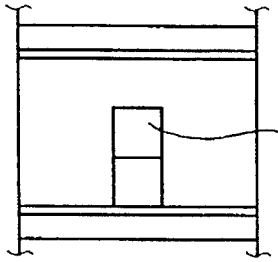
FIG. 10A is a diagram of a first dot pattern for dot characters.
Figure 10B:
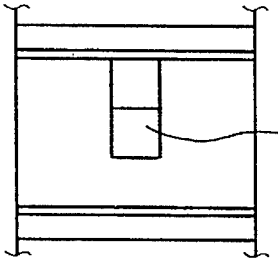
FIG. 10B is a diagram of a second dot pattern for dot characters.
Figure 10C:
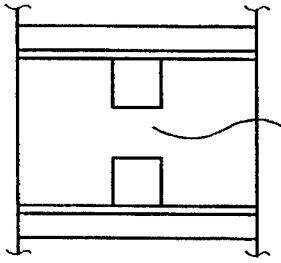
FIG. 10C is a diagram of a third dot pattern for dot characters.
Figure 10D:
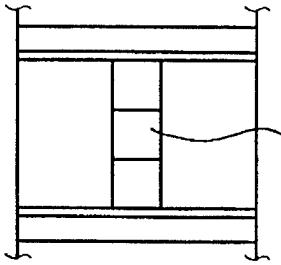
FIG. 10D is a diagram of a fourth dot pattern for dot characters.
Figure 10E:
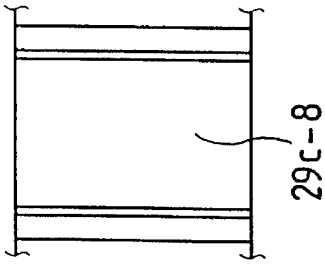
FIG. 10E is a diagram of a fifth dot pattern for dot characters.
Figure 10F:
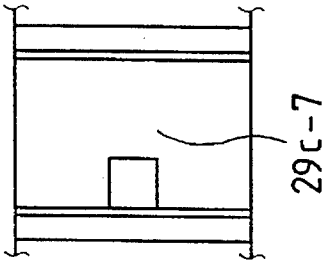
FIG. 10F is a diagram of a sixth dot pattern for dot characters.
Figure 10G:
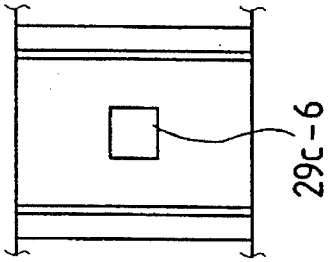
FIG. 10G is a diagram of a seventh dot pattern for dot characters.
Figure 10H:
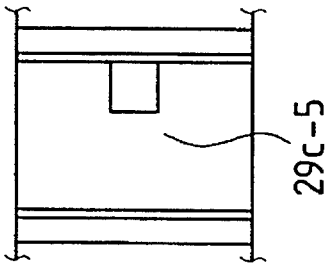
FIG. 10H is a diagram of a eighth dot pattern for dot characters.

FIG. 9 is an illustration of the character belt 27 of the printer 50 of the present embodiment. An array of character bodies 27*a* are arranged at preset pitches on the character belt 27. The character bodies 27*a* are linked to one another by thin coupling portions 27*b*, and a dot character 27*c* is formed on the top face of each of the character bodies 27*a*. In this embodiment, as in the first embodiment, one dot is printed in the vertical direction and two dots are printed in the horizontal direction by one printing operation. Therefore, at least four types of dot characters 27*c*-1 to 27*c*-4 (including space) are required to represent each combination pattern (i.e. dot character 27*c*). A hammer 28 pushes the character bodies 27*a* forward in order to print a dot character 27*c*.

In the present embodiment, during a character advance operation the hammer 28 is moved a distance p16. The distance p16 is twice as long as the distance p2 between the dot formation positions of the horizontally arrayed dots of the same dot character 27*c*. In addition, the distance p2 is equal to distance p3. The distance p3 is the distance between the right-most dot forming position of a dot character 27*c* before the character advance operation and the left-most dot forming position of a dot character after the character advance operation. The pitch p11 of the character bodies 27*a* on the character belt 27 is twice as long as the distance p16. Accordingly, the character belt 27 rotating in the direction of an arrow E is incrementally advanced a distance equal to ½ of the pitch p11 of the character bodies 27*a*. Thus, in this embodiment, the character advance distance p16 is set to $$p16=p2\times 2,$$

since the maximum number n2 of dots is 2. Also, the pitch p11 of the dot character bodies 27*a* is set to $$p11=p16\times 2.$$

The above two equations are set to their corresponding values for the following reasons. If the character advance distance p16 of the hammer 28 is set to be equal to the pitch p11 of the character bodies 27*a* such that the character advance distance p16 is twice as long as the distance p2 between the horizontally arrayed dots, the coupling portion 27*b* must be extremely short. Thus, the coupling portion 27*b* can only be extended a small amount when a character is printed. Consequently, the hammer 28 must exert more force to print a character, and the printed character will be smudged by adjacent dot characters 27*c*. Therefore, the print quality is unsatisfactory.

Also, in this embodiment, the distance p17 is the distance which the paper is fed during a paper feed operation. The distance p17 is equal to the distance p1 which equals the vertical length of a dot. Also, the distance p1 equals the distances p2 and p3 of the horizontally arrayed dots, as in the first embodiment. Therefore, $$p17=p1=p2=p3.$$

Thus, the horizontal and vertical dot distances are uniform, and the characters are printed uniformly and evenly.

FIGS. 10A to 10H show dot characters 29*c* that may be used as dot characters in the first and second embodiments. With these dot characters 29*c*, one dot can be printed in the vertical direction and three dots can be printed in the horizontal direction during one printing operation. Therefore, eight different dot characters 26*c* are needed to form all of the possible combination patterns.

The operation of printing characters, which are usually expressed in a matrix of 7 dots×5 dots, will be described with reference to FIG. 11.

Since each dot character 29*c* may include a maximum number n1 of dots in the paper feed direction (vertical direction) and a maximum number n2 of the dots in the character advance direction (horizontal direction), in this example $$n1=1$$

$$n2=3.$$

Accordingly, the character advance distance p16 of the hammer 28 is $$p16=p2\times n2=p2\times 3$$

where p2 is the horizontal pitch of a dot forming position on the dot character body. Also in the present modification, the distance p17 of paper feed is $$p17=p1\ .$$

Figure 11:
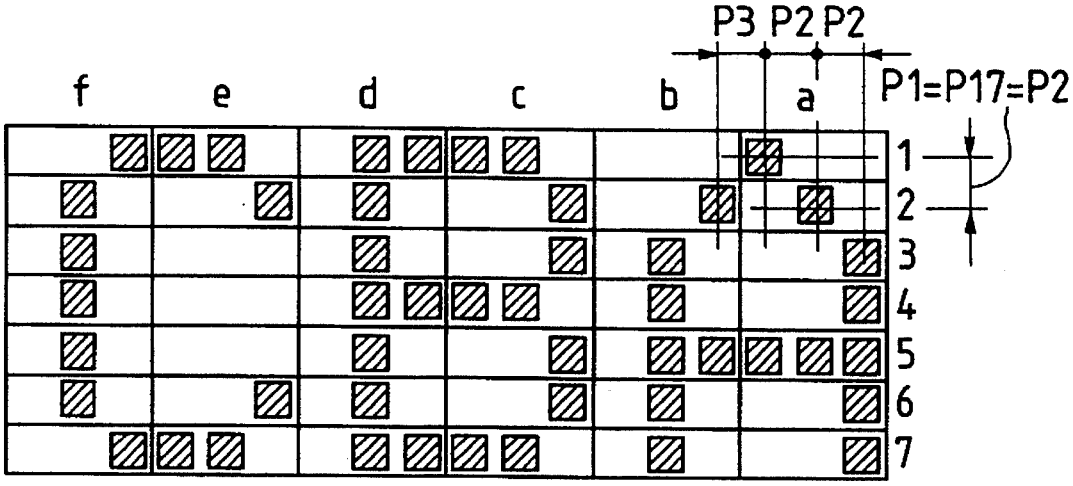
FIG. 11 is a diagram of the printing operation of the small printer using the dot characters shown in FIG. 10.

When the matrix of 7 dots×5 dots is divided by a 1 dot×3 dots dot pattern matrix, the resultant text matrix consists of 7 blocks in the vertical direction and 2 blocks in the horizontal direction, as shown in FIG. 11.

In this modification, the blocks of the first dot line (block 1*a*, block 1*b*, block 1*c*, . . . , block 1*f*) are printed, the carriage 8 is returned to the home position, and the blocks of the second dot line (block 2*a*, block 2*b*, block 2*c*, . . . , block 2*f*) are printed. After this sequence is continued up through the 7th dot line, one line of text is printed. The character advance distance p16 is three times as long as the distance p2 between adjacent dot forming positions of the dot characters 29*c*. Also, the distance p2 is equal to the distance p3 between the right-most dot forming position before the character advance operation and the left-most dot forming position after the character advance operation. In addition, the paper-feed distance p17 is equal to the distances p2 and p3 of the horizontally arrayed dots. Accordingly, the horizontal and vertical dot distances are uniform (p1=p2=p3), and the characters are printed uniformly and evenly.

FIGS. 12A to 12H show another example of dot characters 30*c* that may be used in the first and second embodiments. With these dot character 30*c*, one dot can be printed in the horizontal direction and three dots can be printed in the vertical direction during one printing operation. Therefore, eight different dot characters 30*c* are needed to form all of the possible dot patterns.

In this example, the maximum number of dots in the vertical direction n1 and the maximum number of dots in the horizontal direction n2 of the dot characters 30*c* are $$n1=3$$

$$n2=1.$$

Accordingly, the paper feed distance p17 is $$p17=p1\times n1=p1\times 3$$

where p1 is the dot pitch in the vertical direction. Also in the present modification, the character advance distance p16 is $$p16=p1.$$

Figure 13:
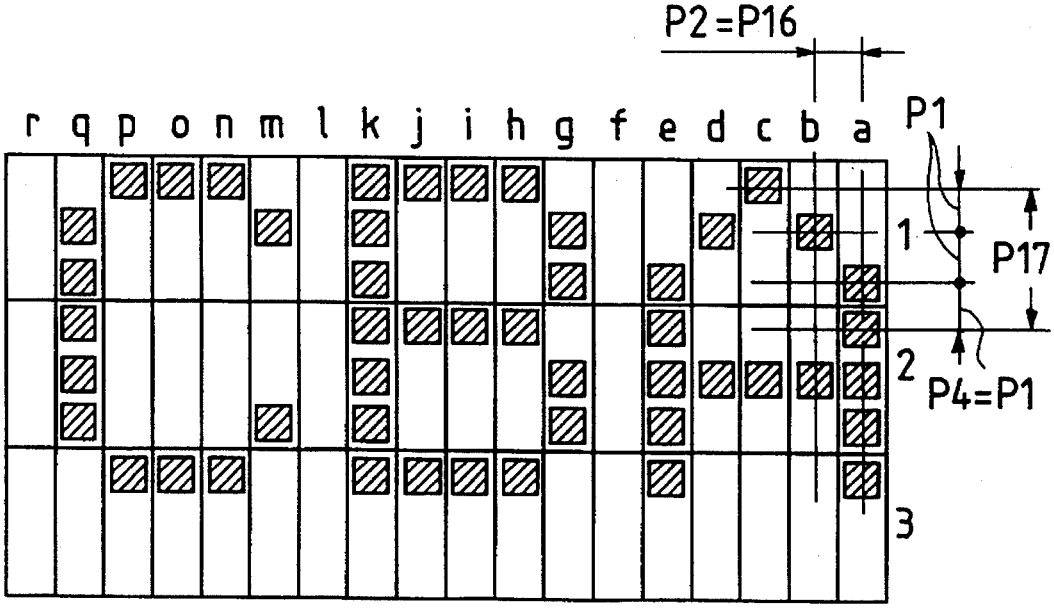
FIG. 13 is a diagram of the printing operation of the small printer using the dot characters shown in FIG. 12.
Figures 12A, 12B, 12C, 12D, 12E, 12F, 12G, 12H:
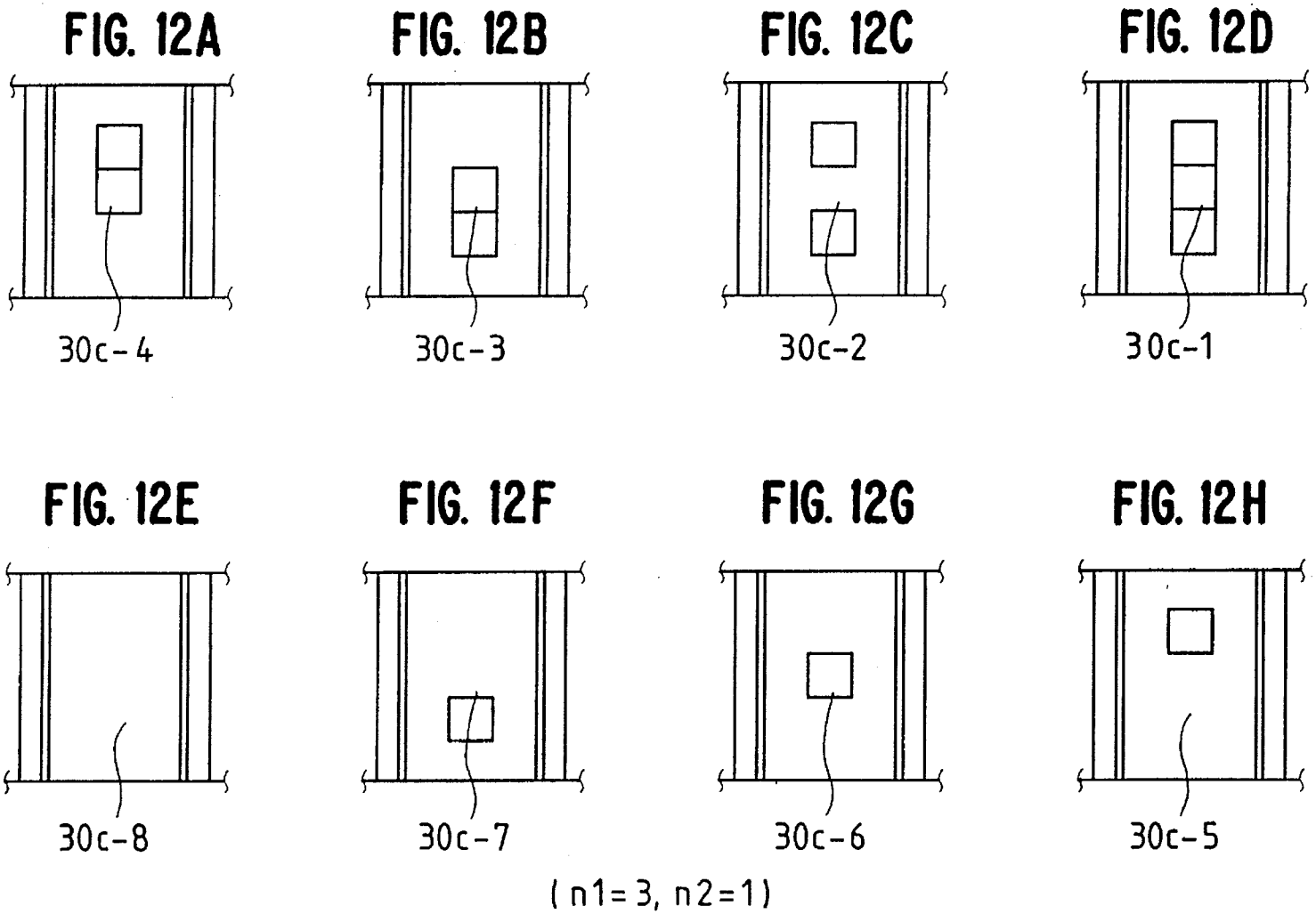
FIG. 12A is a diagram of a first dot pattern for dot characters.
FIG. 12B is a diagram of a second dot pattern for dot characters.
FIG. 12C is a diagram of a third dot pattern for dot characters.
FIG. 12D is a diagram of a fourth dot pattern for dot characters.
FIG. 12E is a diagram of a fifth dot pattern for dot characters.
FIG. 12F is a diagram of a sixth dot pattern for dot characters.
FIG. 12G is a diagram of a seventh dot pattern for dot characters.
FIG. 12H is a diagram of a eighth dot pattern for dot characters.

The operation of printing characters, which are usually expressed in a matrix of 7 dots×5 dots, will be described with reference to FIG. 13. When the matrix of 7 dots×5 dots is divided by a 3 dots×1 dot pattern matrix, the resultant text matrix consists of 3 blocks in the vertical direction and 5 blocks in the horizontal direction, as shown in FIG. 13.

In this modification, the blocks of the first to third dot lines (block 1*a*, block 1*b*, block 1*c*, . . . , block 1*q*) are printed, the carriage 8 is returned to the home position, and the print paper is fed by a distance p17 which is equal to the pitch of three dots. Thereafter, the blocks of the 4th to 6th dot lines (block 2*a*, block 2*b*, block 2*c*, . . . , block 2*q*) are printed. After this operation is continued up through the 7th dot line one line of text is printed. The paper feed distance p17 is three times as long as the distance p1 which equals the vertical pitch of a dot. Also, the distance p1 equals the distance p2 between two adjacent dot forming positions on the same dot character. Accordingly, the horizontal and vertical dot distances are uniform (p1=p2=p3), and the characters are printed uniformly and evenly.

Figures 14A, 14B, 14C, 14D, 14E, 14F, 14G, 14H, 14I, 14J, 14K, 14L, 14M, 14N, 14O, 14P:
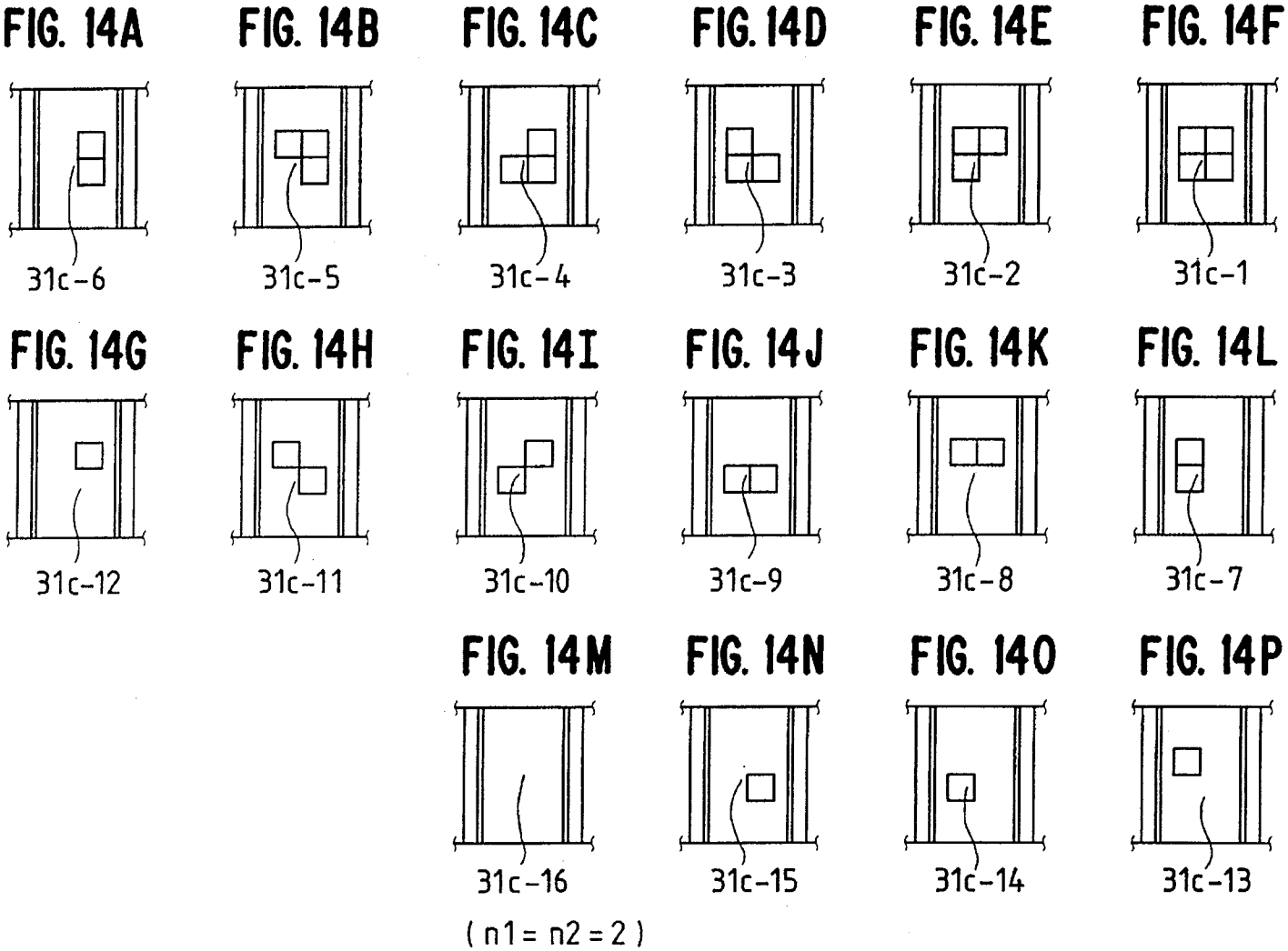
FIG. 14A is a diagram of a first dot pattern for dot characters.
FIG. 14B is a diagram of a second dot pattern for dot characters.
FIG. 14C is a diagram of a third dot pattern for dot characters.
FIG. 14D is a diagram of a fourth dot pattern for dot characters.
FIG. 14E is a diagram of a fifth dot pattern for dot characters.
FIG. 14F is a diagram of a sixth dot pattern for dot characters.
FIG. 14G is a diagram of a seventh dot pattern for dot characters.
FIG. 14H is a diagram of a eighth dot pattern for dot characters.
FIG. 14I is a diagram of a ninth dot pattern for dot characters.
FIG. 14J is a diagram of a tenth dot pattern for dot characters.
FIG. 14K is a diagram of a eleventh dot pattern for dot characters.
FIG. 14L is a diagram of a twelfth dot pattern for dot characters.
FIG. 14M is a diagram of a thirteenth dot pattern for dot characters.
FIG. 14N is a diagram of a fourteenth dot pattern for dot characters.
FIG. 14O is a diagram of a fifteenth dot pattern for dot characters.
FIG. 14P is a diagram of a sixteenth dot pattern for dot characters.

FIGS. 14A to 14P show another example of dot characters 31*c* that may be used as dot characters in the first and second embodiments. With these dot characters 31*c*, two dots can be printed in the vertical direction and two dots can be printed in the horizontal direction during one printing operation (n1=n2=2). Therefore, sixteen different dot characters 31*c* are needed to form all of the combination patterns.

In this example, the vertical and horizontal dot pitches p1 and p2 are equal to each other, and the character advance distance p16 and the paper feed distance p17 are as follows $$p16=p2\times n2=p2\times 2$$

$$p17=p1\times n1=p1\times 2.$$

Figure 15:
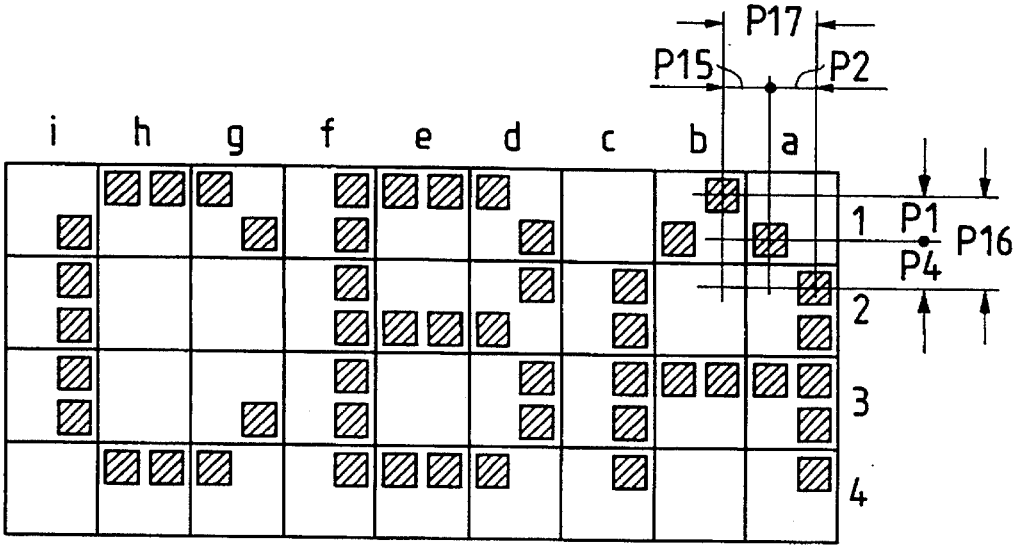
FIG. 15 is a diagram of the printing operation of the small printer using the dot characters shown in FIG. 14.

The operation of printing characters, which are usually expressed in a matrix of 7 dots×5 dots, will be described with reference to FIG. 15. When the matrix of 7 dots×5 dots is divided by a 2 dots×2 dots dot pattern matrix, the resultant text matrix consists of 4 blocks in the vertical direction and 3 blocks in the horizontal direction, as shown in FIG. 15.

In this example, the blocks of the first and second dot lines (block 1*a*, block 1*b*, block 1*c*, . . . , block 1*i*) are printed, the carriage 8 is returned to the home position, and the paper is fed by a distance p17 which is equal to the pitch of two dots. Thereafter, the blocks of the 3rd and 4th dot lines (block 2*a*, block 2*b*, block 2*c*, . . . , block 2*i*) are printed. After this operation is continued up through the 7th dot line, one line of text is printed. The character advance distance p16 is twice as long as the distance p2 between two adjacent dot forming positions on the same dot character 31*c*. Also, the paper feed distance p17 is two times as long as the distance p1. In addition, since the horizontal and vertical dot pitches (p1 and p2) are equal, the characters are printed uniformly and evenly.

Figure 16:
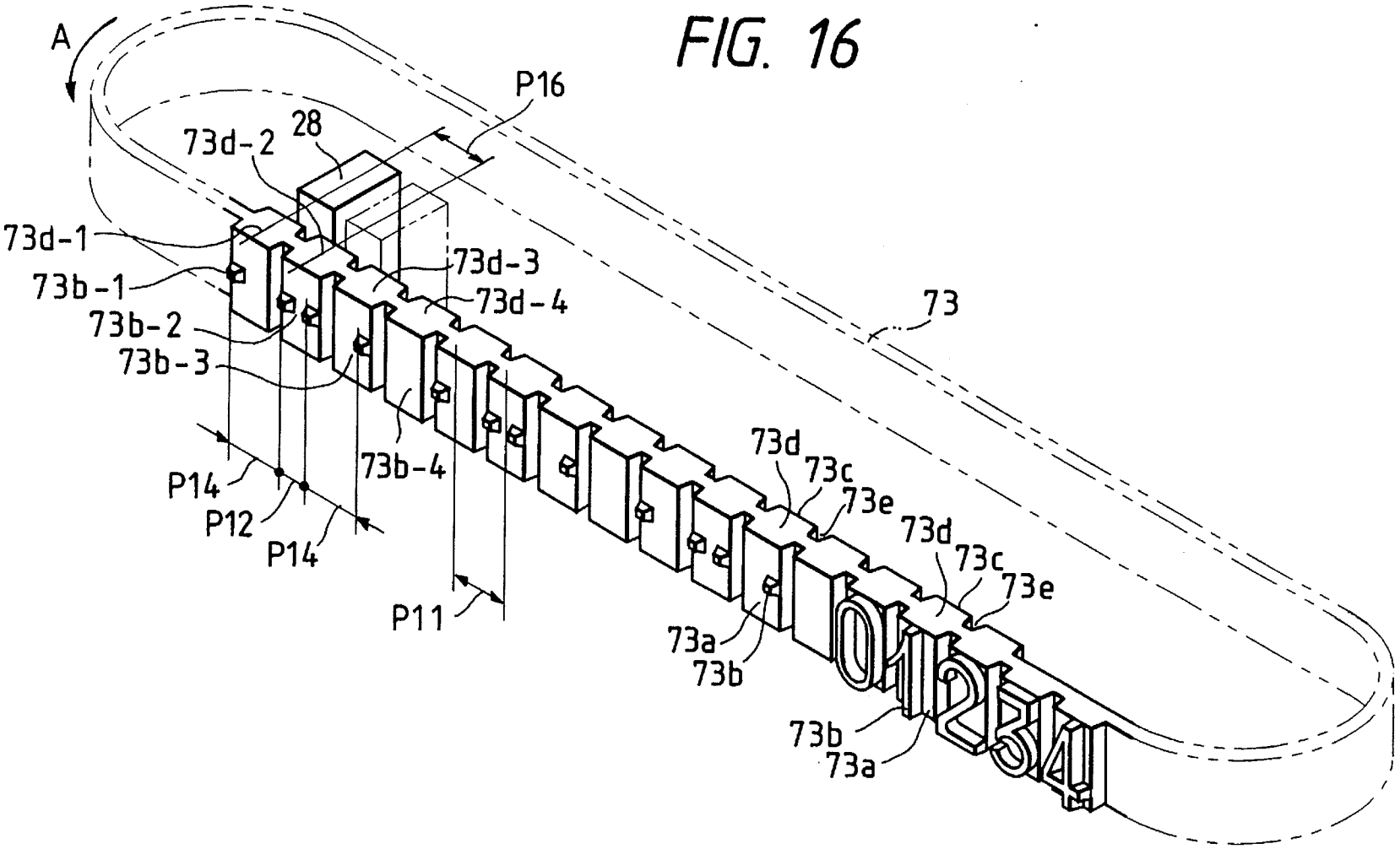
FIG. 16 is a diagram of a character belt of a printer according to a third embodiment of the present invention.

FIG. 16 shows a character belt 73 of a printer according to a third embodiment of the present invention. The overall construction of the printer of this embodiment is similar to that of the second embodiment (FIG. 8).

As shown in FIG. 16, dot character bodies 73*d* of the character belt 73 each comprise a character seat 73*a*, a dot character 73*b* formed on the outer side of the character seat 73*a*, and a belt toothed part 73*c*. The characters formed on the outer side of the character seat 73*a* include dot characters and nondot characters.

In the third embodiment, the pitch p11 represents the distance between corresponding dot forming positions of adjacent dot character bodies 73*d*, the pitch p12 represents the distance between adjacent dot forming positions on the same dot character 73*d*, the distance p13 represents the shortest incremental distance traveled by the character belt 73, the distance p14 represents the distance between a dot-like projection of one dot character 73*d* and the closest dot-like projection of the adjacent dot character 73*d*. The pitch p11, the pitch p12, the distance p13, the distance p14, and the maximum number n of dot forming positions in the horizontal direction on one dot character 73*d* are set as follows:

$$n=2$$

$$p1=p13$$

$$p13=p12\times n=p12\times 2$$

$$p14=p12\times n=p12\times 2.$$

The array of dot character bodies 73*d* are arranged at a pitch p11 and are coupled by coupling portions 73*e*. The character advance distance p16 of the hammer 28, is equal to the pitch p11 between corresponding dot forming positions on adjacent dot character 73*d*. A maximum of two dots are formed on each dot character body 73*d* in the horizontal direction (character advance direction). Therefore, four different dot characters 73*b*-1, 73*b*-2, 73*b*-3, and 73*b*-4 are needed to form all of the dot patterns. Additionally, the dot characters 73*b* are arranged such that the shortest distance p14 between a dot-like projection on a character body and the closest dot-like projection on the adjacent character body is twice as long as the dot pitch p12. As a result, a printed character is not smudged by a character adjacent to the character being printed.

Figure 17:
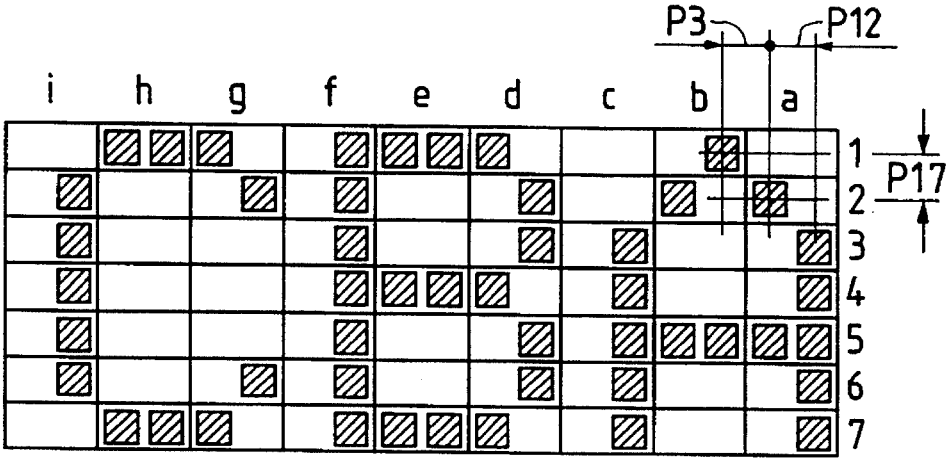
FIG. 17 is a diagram of the printing operation of the small printer using the dot characters shown in FIG. 16.

The operation of printing characters, which are usually expressed in a matrix of 7 dots×5 dots, will be described with reference to FIG. 17. When the matrix of 7 dots×5 dots is divided by a 1 dot×2 dots dot pattern matrix, the resultant text matrix consists of 7 blocks in the vertical direction and 3 blocks in the horizontal direction, as shown in FIG. 17.

The printer prints the first block (block 1*a*) in the first dot line. Since the block 1*a* is blank in this instance, the dot character 73*d*-4 is selected and the print/character advance operation is executed. During the print/character advance operation, the hammer 28 is moved from the location of the block 1*a* to the location of the next block 1*b*. In this example, the character body 73*d*-1 is selected, and the dot character 73*b*-1 is printed. The character advance distance p16 is twice as long as the distance p12 between two adjacent dot forming positions on the same dot character 73*b*. Also, the dot pitch p12 is equal to the distance p3 between the right-most dot forming position before the character advance operation and the left-most dot forming position after the character advance operation.

Subsequently, block 1*c*, block 1*d*, . . . , and block 1*i* are printed. After the final block (block 1*i*) of the first dot line is printed, the hammer holder 61 is returned to the home position, and the paper is fed by a distance p17 which is equal to the distance of one dot line. The hammer 28 is moved to the first block (block 2*a*) of the second line, and the blocks of the second dot line (block 2*a*, block 2*b*, block 2*c*, . . . , block 2*i*) are printed. After this operation is continued up through the 7th dot line, one line of text is printed. The paper feed distance p17 is equal to the distance p1 which equals the vertical length of a dot. Also, the distance p1 equals the horizontal distances p12 and p3. Thus, the horizontal and vertical dot distances are uniform (p1=p12=p3), and the characters are printed uniformly and evenly.

Figure 18:
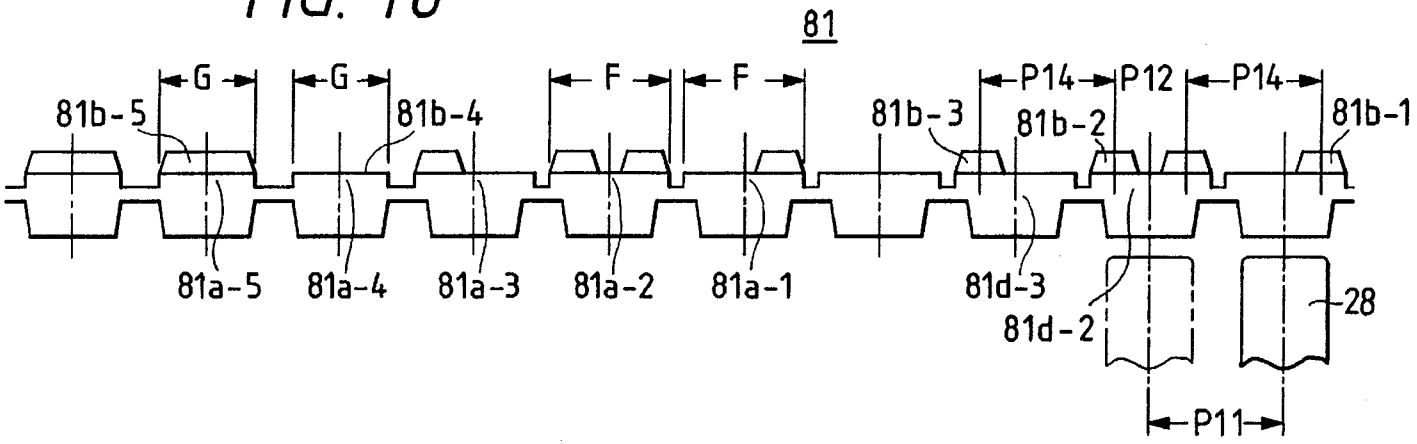
FIG. 18 is a diagram of a modified character belt of FIG. 16.

FIG. 18 shows a modification of the character belt 73. In the third embodiment, all of the character seats 73*a* have the same width. However, the modified character belt 81 is designed such that the width F of the character seats 81*a*-1, 81*a*-2, and 81*a*-3 of the dot characters 81*b*-1, 81*b*-2, and 81*b*-3 is larger than the width G of the character seats 81*a*-4 and 81*a*-5 of the nondot characters 81*b*-4 and 81*b*-5. Furthermore, the individual dots are larger than those in the third embodiment. As a result, the gaps between the printed dots are smaller and harder to see.

The dot characters 81*b* are arranged such that the distance p14 between a dot-like projection on a character body 81*d* and the closest dot-like projection on the adjacent character body 81*d* is twice as long as the distance p12 between two dot forming positions on the same character body 81*d*. Since the gap between the adjacent dot forming positions on the character bodies 81*d* becomes narrower, the adjacent dot characters 81*b* are more likely to smudge a printed character. Thus, the dot characters 81*b* should be strategically arranged on the character belt 81 as illustrated in FIG. 18.

Figure 19:
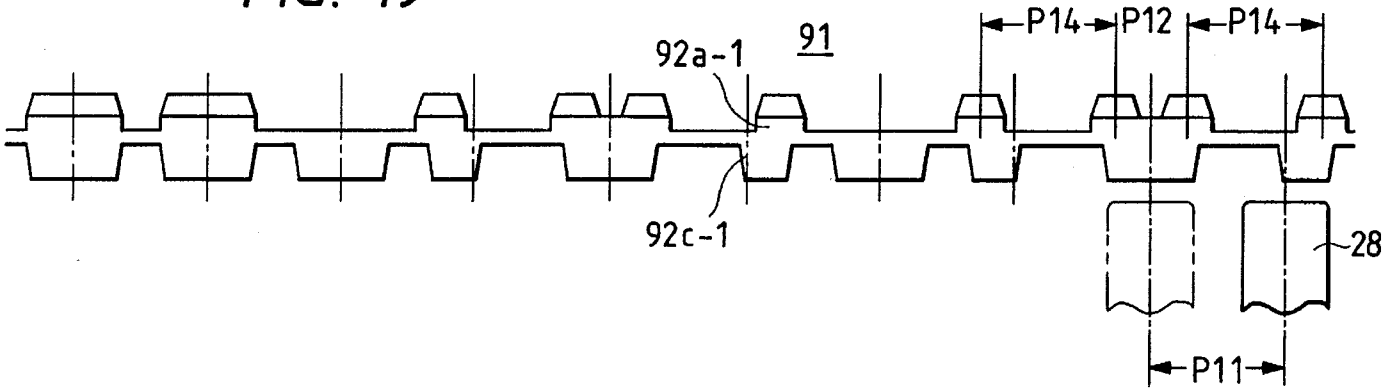
FIG. 19 is a diagram of a modified character belt of FIG. 18.

FIG. 19 shows a modification of the character belt 81. In this modification, the character seat portions 91*a* of a character belt 91, which do not have dot characters formed thereon, and the corresponding belt toothed parts thereof are narrowed in order to lessen the tension created adjacent characters during the printing operation. Consequently, the adjacent characters do not smudge the printed character, and the load to the hammer 28 during the printing operation is lessened. The remaining construction of the character belt 91 is the same as that of the character belt 81.

Figure 20:
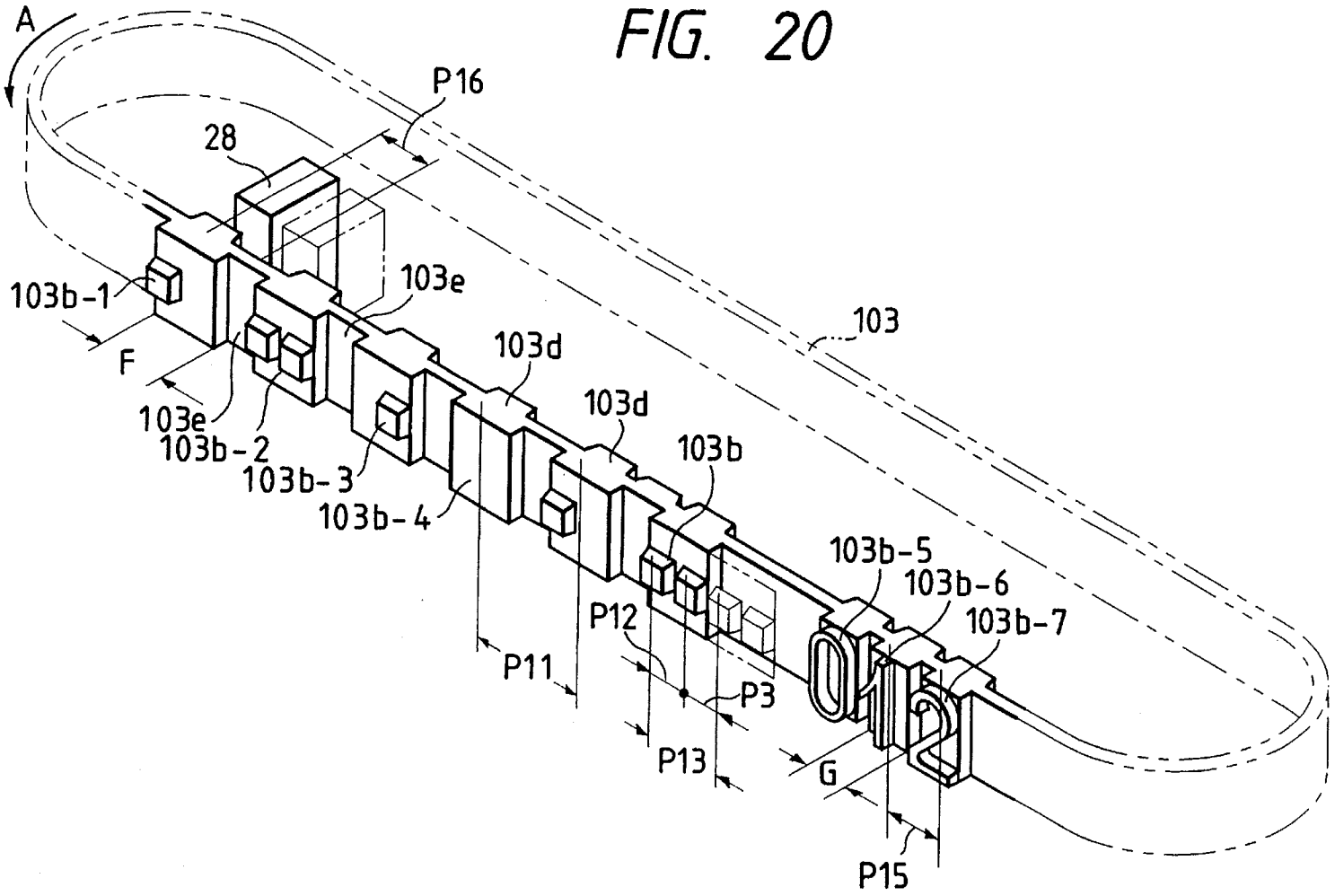
FIG. 20 is a diagram of another modified character belt of FIG. 16.

FIG. 20 shows yet another modification of the character belt 81. In this modification, the pitch p11 between adjacent dot character bodies 103*d* on a character belt 103 is twice as long as the character advance distance p16 of the hammer 28. Accordingly, the character belt 103 rotating in the direction of an arrow A is stopped at ½ of the pitch p11 of the dot character bodies 103*d*. Thus, in this embodiment, the pitch p11 is set to $$p11=p16\times 2$$

The character advance distance p16 of the hammer 28 is twice as large as the distance p12 between two adjacent dot forming positions of the same dot character 103*b*. Also, the distance p12 is equal to the distance p3 between the right-most dot forming position of a dot character body 103*d* before the character advance operation and the left-most dot forming position of the dot character body 103*d* after the character advance operation. Therefore, the distance between the adjacent dot character bodies 103*d* may be further reduced in the character belts shown in FIGS. 18 and 19. Consequently, the adjacent characters are less likely to interfere with the printing of the desired character. Therefore, the problem of a character being smudged by an adjacent character is eliminated, and the load exerted by the hammer 28 during the printing operation is reduced.

In this modification, the width G of the character seats for the nondot characters (e.g., 103*b*-5, 103*b*-6, and 103*b*-7), is smaller than the width F of the character seats (e.g., 103*b*-1 to 103*b*-4) for the dot characters. Therefore, the adjacent characters do not significantly interfere with the printing of a desired nondot character, and the printed nondot character is not smudged. Since the width G is smaller, the distance p15 between the nondot characters can be smaller. The pitch p15 of the nondot characters, in this example, is as follows $$p15=p13.$$

Since the pitch 15 is relatively small, an increased number of characters can be formed on a character belt of limited length.

Furthermore, a space (i.e. not dots) may be printed by stopping the character belt 103 at a position such that the hammer 28 faces the coupling portion 103*e* of the character belt 103. Consequently, there is no need to use the space character 103*b*-4. Therefore, the character belt 103 can further increase the number and variety of characters formed thereon.

In this embodiment, a maximum of two dots are horizontally disposed on each dot character body 103*d*. However, any number of dots may be disposed in the horizontal direction and in the vertical direction in order to accommodate on the functions performed by the printer.

Figure 21:
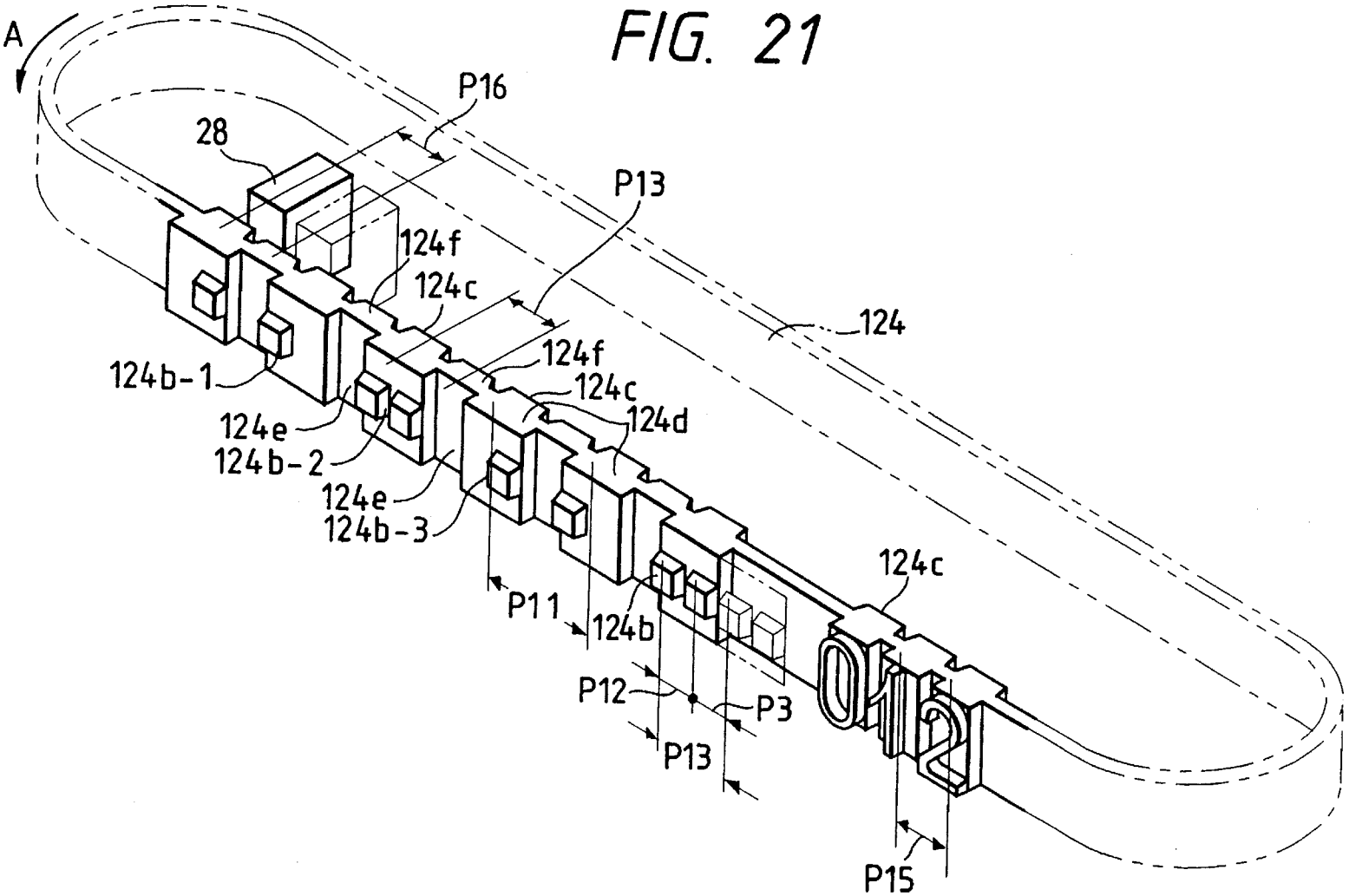
FIG. 21 is a perspective view of a modified character belt of FIG. 20.
Figure 22:
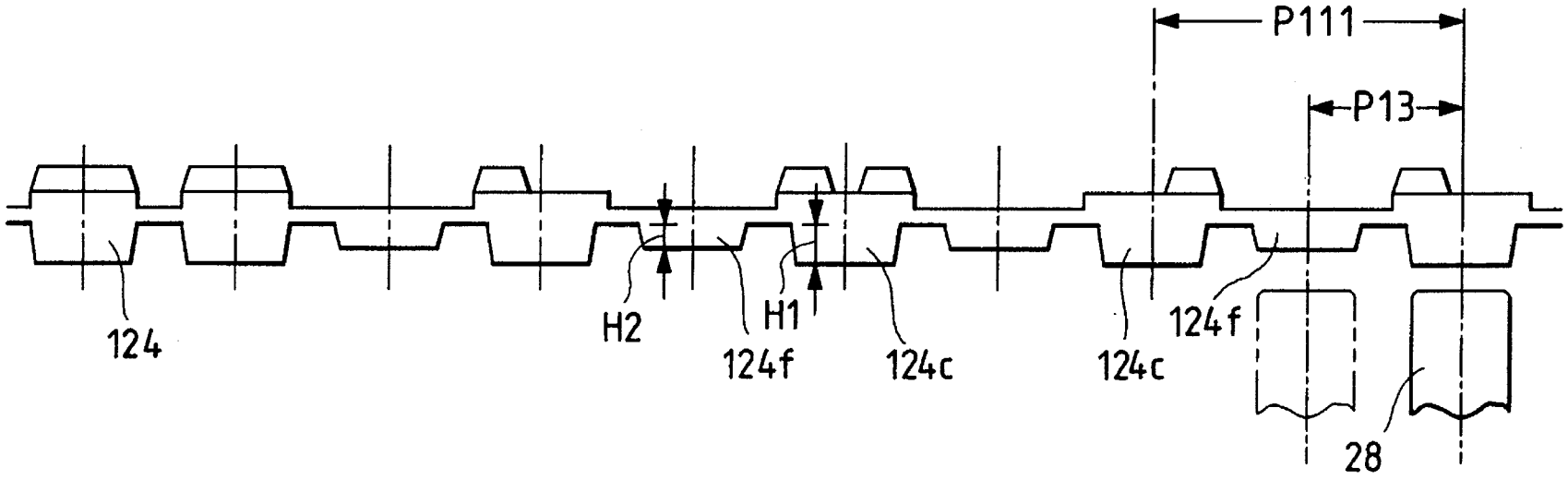
FIG. 22 is a diagram of a cross section of the character belt of FIG. 21.

FIGS. 21 and 22 show an additional modification of the character belt 81. In the character belt 124 illustrated in these figures, the pitch p11 of dot character bodies 124*d* is twice as long as the character advance distance p16 of the hammer 28, as in the previous case. However, in this modification the belt toothed parts 124*f* are formed on the inner side of the coupling portions 124*e* of the character belt 124 in addition to the belt toothed parts 124*c* formed on the inner side of the dot character bodies 124*d*. The belt toothed parts 124*f* and the belt toothed parts 124*c* are alternately disposed on the inner side of the character belt 124 and the distance between a belt toothed part 124*c* and a belt toothed part 124*f* is equal to the character advance distance p16 of the hammer 28. Thus, since a greater number of belt toothed parts 124*c* and 124*f* mesh with the drive pulley 51, the drive force of the drive pulley 51 can be precisely transferred to the character belt 124 reliably and efficiently. Accordingly, a desired character on the character belt 124 can be stopped exactly at a preset position. Furthermore, the drive load of the character belt is significantly decreased.

In addition, a space (i.e. no dots) may be printed by stopping the character belt 124 at a position such that the hammer 28 faces the toothed part 124*f*. Since the height H2 of the toothed part 124*f* is lower than the height H1 of the toothed parts 124*c*, as shown in FIG. 22, the displacement of the character belt 124 is much less when the hammer 28 strikes the character belt 124. Thus, a printed character is hardly smudged by an adjacent character during the printing operation.

The concept of varying the height of alternating belt toothed parts can be applied to each of the character belts of the previous embodiments. An example in which this concept is applied to a previous embodiment will be described with respect to the character belt 73 shown in FIG. 16. In this case, the height of the belt toothed part 73*c* of the space character 73*b*-4 could be made smaller than the height of the belt toothed parts of other characters (73*b*-1 and 73*b*-2). The displacement of the space character 73*b*-4 when it is pushed by the hammer 28 would less than the displacement of the other characters if they were pushed by the hammer 28. As shown previously, this concept is very effective in preventing printed characters from smudging during the printing operation.

As seen from the foregoing description, an wide variety of characters can be selected in accordance with the shape of the character ring and the number of character positions. Accordingly, a printer, capable of printing graphics, such as figures and patterns, can be produced by slightly modifying a conventional printer. In addition, the hammer of the present invention is able to more accurately strike the character that is desired to printed, and the problem of printing chipped and/or smudged characters is solved. Furthermore, characters of different sizes and fonts can be printed by changing the size and design of the dot characters.

Dot characters can also be printed at equal pitches over all of the character positions by using a single character belt. This printer of the present invention is much smaller, particularly in thickness, than conventional printers. Accordingly, the number of components of the printer are less and the cost to manufacture the printer is reduced. Also, the character belt can be manufactured such that there is a large distance between adjacent dot characters. Consequently, smudging of characters by adjacent character is prevented and the load that needs to be exerted by the hammer is reduced. Additionally, when a space is printed by making use of the coupling portions which couple the character bodies, an increased number of characters may be contained on a character belt of a fixed length.

In addition, while the matrix of 7 dots×5 dots is used in the present embodiment, a matrix of another size can be used in the present invention. Graphics can also be printed easily by the printer of the present invention.

In addition, the previous description of the preferred embodiments is provided to enable any person skilled in the art to make or use the present invention. The various modifications to these embodiments will be readily apparent to those skilled in the art, and the generic principles defined herein may be applied to other embodiments without the use of inventive faculty. Therefore, the present invention is not intended to be limited to the embodiments described herein but is to be accorded the widest scope consistent with the principles and novel features disclosed herein.

What is claimed is:

1. A small printer comprising:

a character member which comprises a plurality of linked character bodies disposed on a surface of said character member, wherein some of said character bodies are dot character bodies which have surfaces on which dot characters, which comprise a pattern of dot-like projections, are formed, wherein said pattern is represented by a dot pattern matrix having n1 rows and n2 columns which form at least two matrix locations, wherein at least one of said dot character bodies has a first dot character which has N number of said dot-like projections formed in all of said at least two matrix locations, and wherein at least another of said dot character bodies has a second dot character which has less than said N number of said dot-like projections formed in less than all of said at least two matrix locations;

a select means for selecting a desired character body from said plurality of linked character bodies;

a hammer for pressing said desired character body against a print paper;

a pushing means for driving said hammer; and a character advance means for moving said hammer a first incremental distance in a horizontal direction of said print paper, wherein said first incremental distance is approximately equal to a product of a distance p2 and n2, wherein said distance p2 is approximately equal to a horizontal dot pitch of one of said dot-like projections in said horizontal direction.

2. The small printer according to claim 1, further comprising:

a paper feed means for feeding said print paper a second incremental distance in a direction which is perpendicular to said horizontal direction, wherein said second incremental distance is approximately equal to a product of a distance p1 and n1, wherein said distance 91 is approximately equal to a vertical dot pitch of one of said dot-like projections in said vertical direction.

3. The small printer according to claim 1 wherein a distance p1 is approximately equal to said distance p2 and wherein said distance p1 is approximately equal to a vertical dot pitch of one of said dot-like projections in said vertical direction.

4. The small printer according to claim 2 wherein said distance p1 is equal to said distance p2.

5. The small printer according to claim 1:

wherein at least one of said character bodies is a dot-like character body and wherein said dot-like character body has a surface on which a dot-like character is formed.

6. The small printer according to claim 1, wherein a first size and/or shape of one of said dot-like projections of one of said dot character bodies is different than a second size and/or shape of another of said dot-like projections of another of said dot character bodies.

7. The small printer according to claim 2, wherein a first size and/or shape of one of said dot-like projections of one of said dot character bodies is different than a second size and/or shape of another of said dot-like projections of another of said dot character bodies.

8. The small printer according to claim 1, wherein said character member is a character ring on which said dot character bodies are separated by preset distances and are coupled with each other by coupling portions, wherein said select means comprises support means for supporting said character ring either in said horizontal direction or perpendicular to said horizontal direction and comprises drive means for rotating said character ring and stopping said desired character body at a location between said hammer and said print paper, and wherein said character advance means incrementally moves said character ring and said hammer in said horizontal direction.

9. The small printer according to claim 2, wherein said character member is a character ring on which said dot character bodies are separated by preset distances and are coupled with each other by coupling portions, wherein said select means comprises support means for supporting said character ring either in said horizontal direction or perpendicular to said horizontal direction and comprises drive means for rotating said character ring and stopping said desired character body at a location between said hammer and said print paper, and wherein said character advance means incrementally moves said character ring and said hammer in said horizontal direction.

10. The small printer according to claim 1, wherein said character member is a character belt on which said character bodies are located and are linked by coupling portions, wherein said small printer further comprises support means for supporting said character belt in a manner such that said character belt is rotatable in said horizontal direction, and wherein said select means comprises drive means for rotating said character belt in said horizontal direction and for stopping said desired character body at a location between said hammer and said print paper.

11. The small printer according to claim 2, wherein said character member is a character belt on which said character bodies are located and are linked by coupling portions, wherein said small printer further comprises support means for supporting said character belt in a manner such that said character belt is rotatable in said horizontal direction, and wherein said select means comprises drive means for rotating said character belt in said horizontal direction and for stopping said desired character body at a location between said hammer and said print paper.

12. The small printer according to claim 1, wherein said character member contains a larger number of said character bodies which are statistically used more frequently than said character bodies which are statistically used less frequently.

13. A small printer comprising:

a character belt which comprises a plurality of character bodies on a surface of said character belt, wherein said character bodies are linked by coupling portions, wherein some of said character bodies are dot character bodies, wherein a distance between a point on one dot character body and a corresponding point on an adjacent dot character body is approximately equal to a distance p11, wherein said dot character bodies have a row of n dot forming positions, wherein a distance between a point on one dot forming position and a corresponding point on an adjacent dot forming position is approximately equal to a distance p12, wherein n equals an integer which is greater than or equal to 2, and wherein a dot-like projection is located on at least one of said dot forming positions of at least one of said dot character bodies;

support means for supporting said character belt in a manner such that said character belt is rotatable in a horizontal direction of a print paper;

a hammer for pressing a desired character body against said print paper;

select means for selecting said desired character body which comprises drive means for rotating said character belt in said horizontal direction and for stopping said desired character body at a location between said hammer and said print paper; and character advance means for moving said hammer a first incremental distance in said horizontal direction, wherein said first incremental distance is greater than or equal to a distance p13, wherein said distance p11 is approximately equal to the product of said distance p12, n, and a positive integer m1 and said distance p13 is approximately equal to the resultant of said distance p11 divided by said positive integer m1.

14. The small printer according to claim 13, wherein at least one pair of said dot character bodies are located at adjacent positions and wherein a shortest distance p14 between a dot-like projection on one of said one pair of said dot character bodies and another dot-like projection on another of said one pair of dot character bodies equals the product of said distance p12 and a positive integer m2 greater than two.

15. The small printer according to claim 13, wherein said character bodies comprise a plurality of nondot character bodies which have nondot characters formed thereon and wherein at least two of said nondot character bodies are disposed adjacent to each other at a distance p15, wherein said distance p15 equals said distance p13.

16. The small printer according to claim 14, wherein said character bodies comprise a plurality of nondot character bodies which have nondot characters formed thereon and wherein at least two of said nondot character bodies are disposed adjacent to each other at a distance p15, wherein said distance p15 equals said distance p13.

17. The small printer according to claim 13, wherein said character bodies comprise a dot-like character body which has a dot-like character formed thereon.

18. The small printer according to claim 14, wherein said character bodies comprise a dot-like character body which has a dot-like character formed thereon.

19. The small printer according to claim 13, wherein said positive integer m1 is equal to or greater than 2, and wherein said drive means is capable of selectively stopping one of said coupling portions of said character belt at said location between said hammer and said print paper.

20. A small printer comprising:

a character member which comprises a plurality of linked character bodies disposed on a surface of said character member, wherein said character bodies comprise a dot-like character body which has a surface on which a matrix of dot forming positions are formed, wherein said matrix has n1 rows and n2 columns which form at least two matrix locations, wherein a dot-like character is formed on said surface of said dot-like character body by forming dot-like projections in two adjacent dot forming positions of said matrix such that no space is formed between said dot-like projections, select means for selecting a desired character body from said plurality of linked character bodies;

a hammer for pressing said desired character body against a print paper;

pushing means for driving said hammer; and character advance means for moving said hammer a first incremental distance in a horizontal direction of said print paper, wherein said first incremental distance is approximately equal to a product of a distance p2 and n2, wherein said distance p2 is approximately equal to a horizontal dot pitch of one of said dot-like projections in said horizontal direction.

21. The small printer according to claim 20, wherein said character bodies comprise a plurality of dot character bodies which have surfaces on which dot characters, which comprise a pattern of second dot-like projections, are formed, wherein said pattern is represented by a second matrix of second dot forming positions, wherein said second matrix has n1 rows and n2 columns which form at least two second matrix locations, wherein one of said plurality of dot character bodies has a first dot character which has N number of said second dot-like projections formed in all of said at least two second matrix locations, and wherein at least another of said plurality of dot character bodies has a second dot character which has less than said N number of said second dot-like projections formed in less than all of said at least two second matrix locations.

* * * * *